US008109619B2

(12) United States Patent
Kimura et al.

(10) Patent No.: US 8,109,619 B2
(45) Date of Patent: Feb. 7, 2012

(54) METHOD OF MANUFACTURING LIQUID CONTAINER AND LIQUID CONTAINER MANUFACTURED USING THE SAME

(75) Inventors: Hitotoshi Kimura, Matsumoto (JP); Yuji Aoki, Matsumoto (JP); Takeshi Iwamuro, Matsumoto (JP); Hiroshi Nose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 462 days.

(21) Appl. No.: 12/206,545

(22) Filed: Sep. 8, 2008

(65) Prior Publication Data

US 2009/0064501 A1 Mar. 12, 2009

(30) Foreign Application Priority Data

Sep. 10, 2007 (JP) ..... 2007-234009
Sep. 11, 2007 (JP) ..... 2007-234955
Sep. 28, 2007 (JP) ..... 2007-254488

(51) Int. Cl.
*B41J 2/175* (2006.01)
*B41J 2/195* (2006.01)

(52) U.S. Cl. ..... 347/86; 347/7

(58) Field of Classification Search ..... 347/7, 86
See application file for complete search history.

(56) References Cited

U.S. PATENT DOCUMENTS

| | | | | |
|---|---|---|---|---|
| 5,721,576 | A * | 2/1998 | Barinaga | 347/85 |
| 6,390,616 | B2 * | 5/2002 | Shinada et al. | 347/86 |
| 2005/0099449 | A1 | 5/2005 | Frasure et al. | |
| 2005/0157109 | A1 | 7/2005 | Muranaka et al. | |
| 2006/0132555 | A1 * | 6/2006 | Uehara et al. | 347/85 |
| 2006/0227190 | A1 * | 10/2006 | Ishizawa et al. | 347/86 |
| 2007/0186984 | A1 * | 8/2007 | Kimura | 137/588 |
| 2007/0188529 | A1 | 8/2007 | Zhang | |

FOREIGN PATENT DOCUMENTS

| | | | |
|---|---|---|---|
| EP | 0 561 081 | A2 | 9/1993 |
| EP | 1 462 263 | A2 | 9/2004 |
| EP | 1 820 653 | A2 | 8/2007 |
| JP | 59-227458 | A | 12/1984 |
| JP | 2003-305863 | A | 10/2003 |
| JP | 2005-199448 | A | 7/2005 |
| JP | 2005-199516 | A | 7/2005 |
| JP | 2005-225164 | A | 8/2005 |
| JP | 2006-216112 | A | 8/2006 |
| JP | 2007-130812 | A | 5/2007 |
| JP | 2008-037016 | A | 2/2008 |

* cited by examiner

*Primary Examiner* — Stephen Meier
*Assistant Examiner* — Tracey McMillion
(74) *Attorney, Agent, or Firm* — Kilpatrick Townsend & Stockton LLP

(57) ABSTRACT

A liquid container manufacturing method including a storage container which is storable a liquid receptacle, and including preparing the liquid container for which a liquid housed in the liquid receptacle is supplied to the outside via a flow path inside a liquid volume detector device, filling the liquid in the liquid receptacle stored in the storage container, and connecting the liquid volume detector device to the liquid receptacle filled with liquid.

15 Claims, 35 Drawing Sheets

METHOD OF MANUFACTURING LIQUID CONTAINER AND LIQUID CONTAINER MANUFACTURED USING THE SAME

BACKGROUND OF THE INVENTION

1. Field of the Invention

The present invention relates to a liquid container manufacturing method, and to a liquid container manufactured using the liquid container manufacturing method.

2. Description of the Related Art

An ink cartridge for housing ink is one known liquid container that houses a liquid inside, for example. Also ink cartridges equipped with an ink volume sensor used to detect the ink volume stored in the ink cartridge are known.

Various methods are known to charge liquids to a liquid container inside of which a liquid receptacle is stored, including an ink cartridge inside of which an ink pack is stored. For example, technology is known by which it is possible to fill liquid in a liquid container by a step of pressurizing liquid in the liquid container in the inflow direction and a step of vibrating the liquid.

However, among such liquid receptacles, there are liquid receptacles equipped with a liquid volume detector device for detecting the remaining volume or consumed volume of the liquid stored therein, and when filling liquid in these liquid containers, there was the risk of problems occurring with the liquid volume detector device, due to the flow dynamics of the filled liquid, the air bubbles that occur during filling, and the like.

Also, after manufacturing, when filling liquid in the liquid container in a state with the return check valve inside the liquid receptacle functioning, it was not possible to easily execute because the flow path for filling the liquid was blocked by the return check valve.

Furthermore, in the past, when manufacturing ink cartridges equipped with an ink volume sensor, an ink receptor already filled with ink is connected to the ink volume sensor. Therefore, when connecting the ink receptor to the ink volume sensor, there is the risk of ink leakage occurring.

Another problem is that of having to perform ink filling twice, with ink filling to the ink receptor and ink filling to the ink volume sensor. Specifically, first, ink is filled in the ink receptor; and subsequently, after connecting the ink receptor to the ink volume sensor, ink has to be charged (introduced) into the ink volume sensor from the ink receptor.

These problems are not limited to ink cartridges, but rather are problems common to liquid containers and to liquid containers equipped with liquid receptacles and liquid volume sensors.

The present invention is intended to address the problems of the prior art described above at least in part, and has as one object to reduce the occurrence of problems with the liquid volume detector device when a liquid container equipped with a liquid volume detector device is filled.

It is another object of the present invention to easily regenerate a liquid container for which a liquid receptacle is stored inside.

It is yet another object of the present invention to reduce liquid leakage during the process of filling a liquid in the liquid container and to simplify the filling process.

SUMMARY OF THE INVENTION

The invention of this application uses the following aspects in order to address at least part of the problems noted above.

The first aspect provides a method of manufacturing a liquid container. The method of the first aspect of the present invention comprises preparing the liquid container having a storage container capable of storing a liquid receptacle, the liquid housed in the liquid receptacle is supplied to the outside via a flow path inside a liquid volume detector device; charging liquid into the liquid receptacle stored in the storage container; and connecting the liquid volume detector device to the liquid receptacle filled with liquid.

With the method of the first aspect, the liquid is charged with the liquid volume detector device removed from the liquid container, so the filled liquid does not pass through the liquid volume detector device. Thus, even where the liquid container is equipped with a liquid volume detector device, it is possible to reduce the occurrence of problems with the liquid volume detector device caused by filling with liquid.

In the method of the first aspect, the liquid volume detector device connected to the liquid receptacle may be removed, and filling the liquid to the liquid receptacle may be carried out by charging the liquid into the liquid receptacle from which the liquid volume detector device has been removed. In this case, even when charging a liquid in order to reuse a liquid receptacle equipped with a liquid volume detector device, it is possible to reduce the occurrence of problems with the liquid volume detector device caused by filling with liquid, because the liquid volume detector device has been removed from the liquid receptacle before filling.

The method of the first aspect may also include introducing the liquid filled in the liquid receptacle to the flow path of the liquid volume detector device. In this case, it is possible to eliminate air bubbles inside the flow path of the liquid volume detector device using the introduced liquid, making it possible for the liquid container to supply liquid with stability.

The method of the first aspect may also include introducing the liquid to the flow path of the liquid volume detector device in advance before connecting the liquid volume detector device to the liquid receptacle. In this case, by introducing the liquid into the flow path of the liquid volume detector device in advance, it is possible to reduce the occurrence of air bubbles inside the flow path so that the liquid container may supply liquid consistently.

The method of the first aspect may also include cleaning the flow path of the liquid volume detector device prior to connecting the liquid volume detector device to the liquid receptacle. In this case, by performing cleaning, it will be possible to eliminate air bubbles inside the flow path of the liquid volume detector device, making it possible for the liquid container to supply liquid consistently.

With the method of the first aspect, the introduction of the liquid filled in the liquid receptacle to the flow path of the liquid volume detector device may be executed by introducing liquid to the flow path of the liquid volume detector device until the liquid filled in the liquid receptacle reaches a specified volume. In this case, the liquid receptacle discharges liquid to the liquid volume detector device until a specified volume is reached. By doing this, the liquid receptacle is able to maintain the appropriate liquid volume housed in the liquid receptacle, and the liquid container is able to supply the liquid appropriately.

With the method of the first aspect, the storage container may have an opening that is closed off by a flexible member, and for filling of the liquid in the liquid receptacle to be carried out by filling the liquid receptacle stored in the storage container through the opening. In this case, it is possible to fill the liquid in the liquid receptacle stored in the storage container whose opening is closed by the flexible member.

In the method of the first aspect, the liquid may be ink, and introduction of liquid to the liquid receptacle may be executed by introducing ink of a specified temperature to the flow path of the liquid volume detector device. In this case, by making the ink a specified temperature, the ink is more easily filled in the flow path of the liquid volume detector device.

The second aspect provides a method of manufacturing a liquid container. The method of the second aspect comprises preparing a liquid receptacle capable of housing a liquid; storing the liquid receptacle in a storage container capable of storing the liquid receptacle; charging liquid into the liquid receptacle stored in the storage container; and connecting a liquid volume detector device to the liquid receptacle filled with liquid.

With the method of the second aspect, even in the case of manufacture of a liquid container equipped with a liquid volume detector device, the liquid will not pass through the liquid volume detector device during filling because the liquid volume detector device is attached only after the liquid has been charged into the liquid receptacle. Therefore, it is possible to manufacture a liquid container experiencing fewer problems with the liquid volume detector device due to liquid filling.

The method of the second aspect may include using a flexible member to close an opening of the storage container in which the liquid receptacle is stored. In this case, it is possible to charge the liquid with fewer problems of the liquid volume detector device in a liquid container equipped with a storage container whose opening is closed off with a flexible member.

The method of the second aspect may also include introducing a liquid for charging into the liquid receptacle into a flow path of the liquid volume detector device. In this case, by introducing the liquid in the flow path of the liquid volume detector device in advance, it is possible to reduce the occurrence of air bubbles inside the flow path, making it possible for the liquid container to supply liquid with stability.

With the method of the second aspect, the introduction of the liquid to the liquid receptacle may be executed by filling the flow path of the liquid volume detector device with liquid until the liquid filling the liquid receptacle reaches a specified volume. In this case, the liquid receptacle will discharge liquid to the liquid volume detector device until a specified volume is reached. Therefore, it is possible to maintain an appropriate volume of liquid in the liquid receptacle, and it is possible for the liquid container to appropriately supply the liquid.

In the method of the second aspect, the liquid may be ink, and introduction of liquid to the liquid receptacle may be executed by introducing ink of a specified temperature to a flow path of the liquid volume detector device. In this case, by making the ink a specified temperature, it is easy to fill the ink in the flow path of the liquid volume detector device.

The third aspect provides a method of manufacturing a liquid container. The method of the third aspect provides preparing the liquid container having a liquid receptacle capable of housing liquid, and a storage unit which stores the liquid receptacle and for which the opening is sealed by a sealing member; separating at least part of the sealing member from the storage unit, removing the liquid receptacle stored in the storage unit from the opening to outside the storage unit; storing a liquid receptacle filled with liquid from the opening to the storage unit; and sealing the opening of the storage unit in which the liquid receptacle filled with liquid is stored with a sealing member.

With the method of the third aspect, even when liquid is charged into a used liquid container, the liquid receptacle is removed from the opening and the liquid receptacle filled with liquid is stored in the liquid container from the opening, so it is possible to easily fill liquid in the liquid container.

The method of the third aspect may include machining the contact surface of the storage unit that contacts the sealing member, and sealing may be executed by adhering the sealing member to the processed contact surface. In this case, it is possible to make adhesion of the sealing member and the contact surface of the storage unit during sealing easy.

The method of the third aspect may also include filling liquid in the liquid receptacle; and the storing may be executed by storing the filled liquid receptacle in the storage unit. In this case, because storing in the storage unit is done after filling the liquid in the liquid receptacle, it is possible to easily fill liquid in the liquid container.

With the method of the third aspect, the machining may also be executed by smoothing the contact surface of the storage unit through cutting or grinding. In this case, by smoothing the part that contacts the sealing member of the storage container, it is possible to make adhesion of the sealing member easy.

With the method of the third aspect, sealing may also be executed by heat bonding of the sealing member to the storage unit. In this case, it is possible to seal the opening by adhering the sealing member to the storage unit using heat bonding.

With the method of the third aspect, it is possible to execute sealing through ultrasonic welding of the sealing member to the storage unit. In this case, it is possible to seal the opening by adhering the sealing member to the storage unit using ultrasonic welding.

With the method of the third aspect, the sealing maybe executed through vibration bonding of the sealing member to the storage unit. In this case, it is possible to seal the opening by adhering the sealing member to the storage unit using vibration bonding.

With the method of the third aspect, the sealing maybe executed by adhering the sealing member to the storage unit using an adhesive. In this case, it is possible to seal the opening by adhering the sealing member to the storage unit using an adhesive.

With the method of the third aspect, the storing maybe executed by storing the liquid receptacle not equipped with a return check valve in the storage unit. In this case, it is possible to easily fill the liquid because the inflow of the liquid is not blocked by a return check valve during filling of the liquid to the liquid receptacle.

With the method of the third aspect, the liquid container may also be equipped with a liquid volume detector device capable of detecting the volume of a liquid housed in the liquid receptacle. In this case, the flow path inside the liquid volume detector device is not used during regeneration, so it is possible to easily do regenerating of liquid containers for which a liquid volume detector device is mounted.

The fourth aspect provides a method of manufacturing a liquid container. The fourth aspect comprises preparing a liquid container for which a liquid receptacle and a liquid supply port are linked via a liquid volume detector; connecting a liquid reservoir and the liquid supply port; and charging liquid into the liquid receptacle housed in the liquid container and connected with the liquid volume detector via the liquid supply port and the liquid volume detector.

According to the fourth aspect, liquid is charged into the liquid receptacle housed in the liquid container and connected to the liquid volume detector, so it is possible to reduce liquid leakage during the process of charging the liquid in the liquid container and to simplify the filling process.

With the fourth aspect, the charging the liquid in the liquid receptacle may be performed using pressurized filling. In this case, it is possible to shorten the time required for the filling process.

With the fourth aspect, the liquid reservoir may have a pressurized supply device that may supply liquid at a specified pressure and the pressurized filling may be executed using the pressurized supply device. In this case, it is possible to charge the liquid at a desired specified pressure.

With the fourth aspect, the liquid reservoir may be arranged at a position higher than the liquid container and the pressurized filling may be executed using the water head difference between the liquid reservoir and the liquid container. In this case, it is possible to execute the filling process without using power.

With the fourth aspect, the liquid volume detector may have a first flow path linking the liquid supply port and the liquid receptacle, and a second flow path closed using a specified biasing force by a biasing member; and for pressurized filling to be executed using pressure of the biasing force or less. Alternatively, pressurized filling may be executed using pressure higher than the biasing force. In the former case, it is possible to inhibit inflow of air bubbles to the second flow path, and also possible to reduce the air bubble volume that remains in the liquid volume detector. In the latter case, it is possible to shorten the liquid filling processing time.

With the fourth aspect, the discharge part of the charged liquid from the liquid supply port of the liquid container may be filled with liquid. In this case, it is possible to further induce the discharging of air bubbles within the liquid volume detector.

With the fourth aspect, the liquid receptacle may have a return check valve unit that operates by being operated from the outside, and the method may include activating the reverse check valve unit of the liquid receptacle after being filled with liquid. In this case, even if the liquid receptacle has a return check valve, it is possible to fill liquid smoothly.

With the fourth aspect, the liquid container may be a used liquid container, and the filling of the liquid in the liquid receptacle is refilling. In this case, it is possible to execute the filling process to a used liquid container without disassembling the liquid container.

The fifth aspect provides a liquid container manufactured using any of the first to fourth aspects.

The present invention may be reduced to practice in various aspects, for example, a liquid container regenerated or manufactured using the manufacturing method; a device for realizing the manufacturing method; a program for executing the manufacturing method on a device, or the like.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DESCRIPTION OF THE PREFERRED EMBODIMENTS

Figure 1:
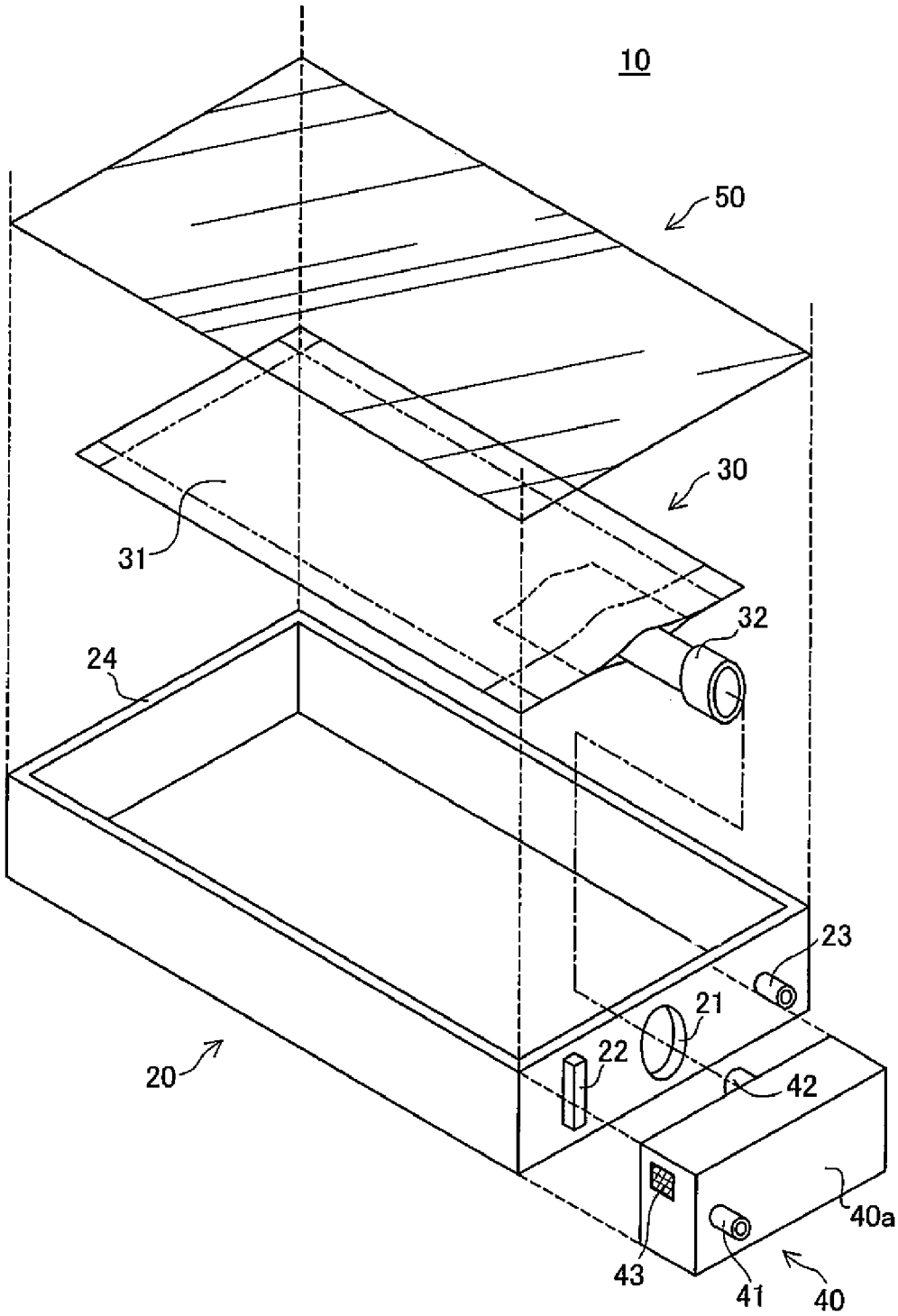
FIG. 1 is an explanatory drawing showing the schematic structure of the ink cartridge of the first embodiment.

Following, the method of manufacturing a liquid container and a liquid container manufactured by the method according to the present invention are described based on embodiments while referring to the drawings.

First Embodiment

The schematic structure of an ink cartridge that is the liquid container of the first embodiment will now be described. FIG. 1 is an explanatory drawing showing the schematic structure of the ink cartridge. The ink cartridge 10 includes a storage container 20, an ink pack 30, a sensor 40, and a flexible member 50. The ink cartridge 10 of this embodiment contains ink housed in the ink pack 30 constituting a liquid receptacle supplied to a printer (not illustrated) via the sensor 40 which is the liquid volume detector device. Note that the liquid container can also be called a liquid supply body.

The storage container 20 has a roughly cabinet shape, and is equipped with an opening 24*a* formed by the opening edge 24 on the top surface. The storage container 20 is formed from a thermoplastic resin such as polystyrene or the like. The storage container 20 has the ink pack 30 stored in the inside of the container from the opening 24*a*. At the side surface of the storage container 20 are provided a pass-through port 21, a sensor fixing unit 22, and a pressurization port 23. The pass-through port 21 is engaged with the discharge unit 32 of the ink pack 30 stored in the inside of the storage container 20, and the ink inside the ink pack 30 can be discharged to outside the storage container 20. The sensor fixing unit 22 fixes the sensor 40 so as to be detachable to the outside surface of the storage container 20. The sensor fixing unit 22 can be a member that is engaged using a convex/concave shape, or can be constituted using a magnet. The pressurization port 23 is able to inflow air to the inside of the storage container 20.

The ink pack 30 has a bag 31 and a discharge unit 32. The ink pack 30 houses ink on the inside of the bag 31, and discharges the housed ink from the discharge unit 32 to outside the ink pack 30. The bag 31 is formed by pasting together the mutual peripheral edge parts of aluminum laminate multi layer films formed by lamination of aluminum layers on a resin film layer. The discharge unit 32 has a roughly round cylinder shape, is connected via the pass-through port 21 to an introduction port 42 that the sensor 40 is equipped with, and leads out the ink housed in the bag 31 to the sensor 40.

The sensor 40 performs detection of the remaining volume of ink housed in the ink pack 30. The sensor 40 has a sensor case 40*a*, a lead-out port 41, an introduction port 42, and an integrated circuit substrate 43. The sensor 40 introduces ink housed in the ink pack 30 from the introduction port 42, and leads it out from the lead-out port 41 connected to the printer via the inside of the sensor case 40*a*. With this embodiment, the sensor 40 has a function of detecting the remaining volume of ink inside the ink pack 30, but the sensor 40 can also be equipped with a function of detecting the consumed volume of ink consumed by the printer, the flow volume of ink that passes through the flow path of the sensor 40, or the retained volume of ink housed in the ink receiving unit. The integrated circuit substrate 43 is electrically connected to a printer (not illustrated), and provides to the printer the information relating to the residual volume of ink inside the ink pack 30 detected by the sensor 40.

The flexible member 50 is a flexible film made of polyethylene terephthalate. The flexible member 50 is welded to the opening edge 24 of the storage container 20, and closes the opening 24*a*. The welding is implemented by fusion using heat of the thermoplastic resin constituted on the surface that contacts the opening edge 24. The adhesion of the flexible member 50 and the opening edge 24 can be accomplished not only by heat bonding, but also by ultrasonic welding, vibration bonding, or using an adhesive.

Figure 2:
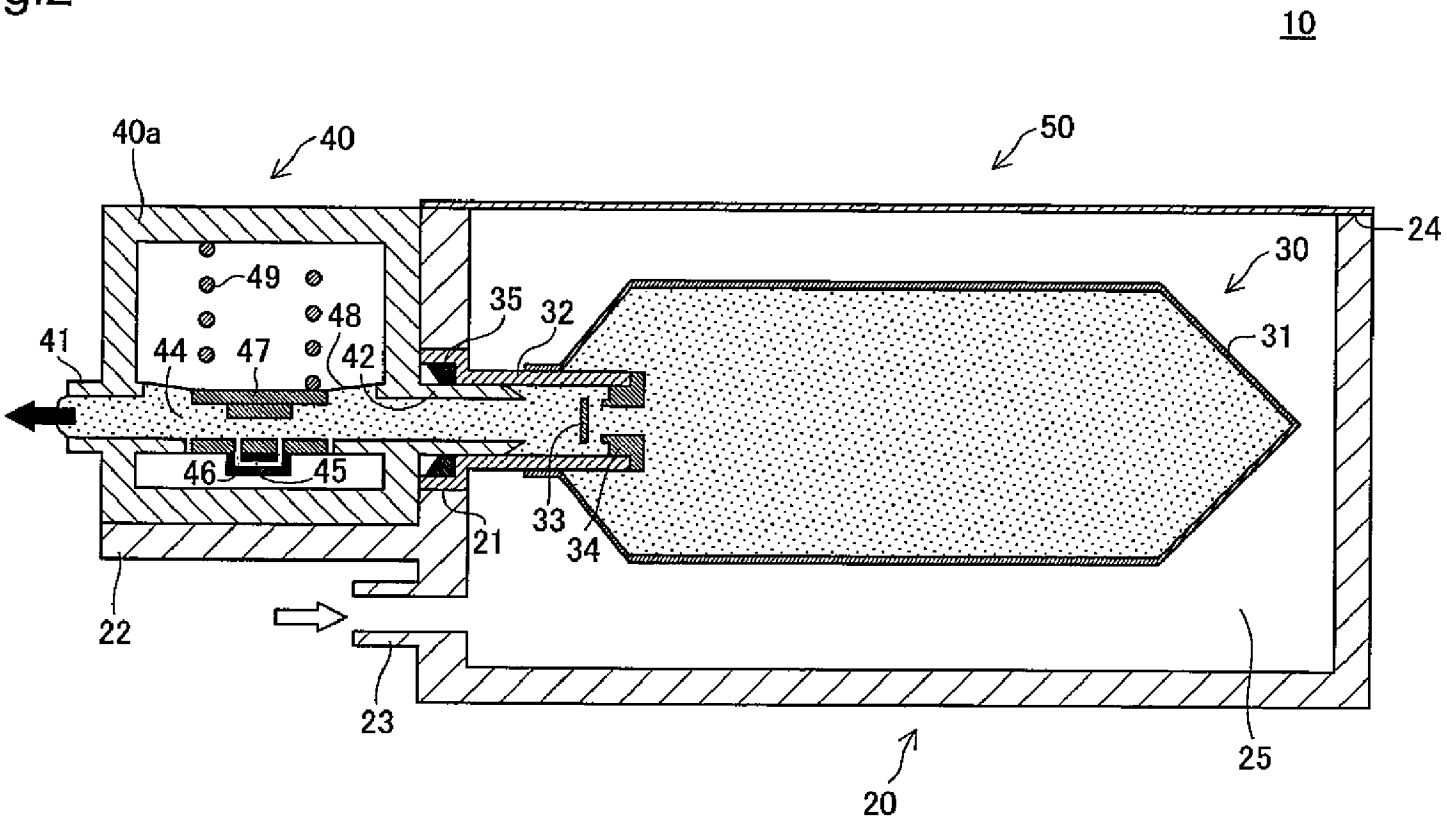
FIG. 2 is an explanatory drawing showing the schematic structure of the cross section of the ink cartridge of the first embodiment.

FIG. 2 is an explanatory drawing showing the schematic structure of the cross section of the ink cartridge. Inside the storage container 20 in which the ink pack 30 is stored is formed a pressurization chamber 25 which is sealed by the flexible member 50 and for which liquid other than that from the pressurization port 23 cannot go in or out of the inside. By injecting gas inside the pressurization chamber 25 from the pressurization port 23, the ink pack 30 is compressed, and the ink housed in the ink pack 30 is discharged.

The ink pack 30 is equipped with a return check valve 33, a valve seat 34, and packing 35 in the discharge unit 32. The return check valve 33 is a roughly plate shaped valve having roughly the same shape as the inside cross section of the discharge unit 32. The return check valve 33 is separated from the valve seat 34 by the flow dynamics of the ink when discharging the ink housed in the bag 31 to outside the bag 31, and this makes discharging of the ink possible, but when inflowing ink to the bag 31, it contacts the valve seat 34 by the flow dynamics in the opposite direction as when discharging, and functions so as to block the inflow of ink. The packing 35 forms a ring shape on the inside of the discharge part 32, and when the discharge part 32 is connected to the introduction port 42, by filling in the gaps, outflow of ink from the connection part to the outside is prevented.

The sensor case 40*a* is equipped with a liquid flow path 44, a piezoelectric vibrating component 45, a liquid detection path 46, a bearing plate 47, a diaphragm 48, and a spring 49. A flow path in the claims includes the liquid flow path and the liquid detection path 46. Depending on the volume of ink that flows through the liquid flow path 44 formed by the diaphragm 48 and the bearing plate 47, the bearing plate 47 rises and falls in resistance to the bias of the spring 49. The free vibration of the vibrating plate of the piezoelectric vibrating component 45 is permitted or restricted by the rise and fall operation of the bearing plate 47, and with the back electromotive force generated in the piezoelectric vibrating component 45 by this free vibration, signals representing the presence or absence of ink in the printer are output from the integrated circuit substrate 43.

Figure 3:
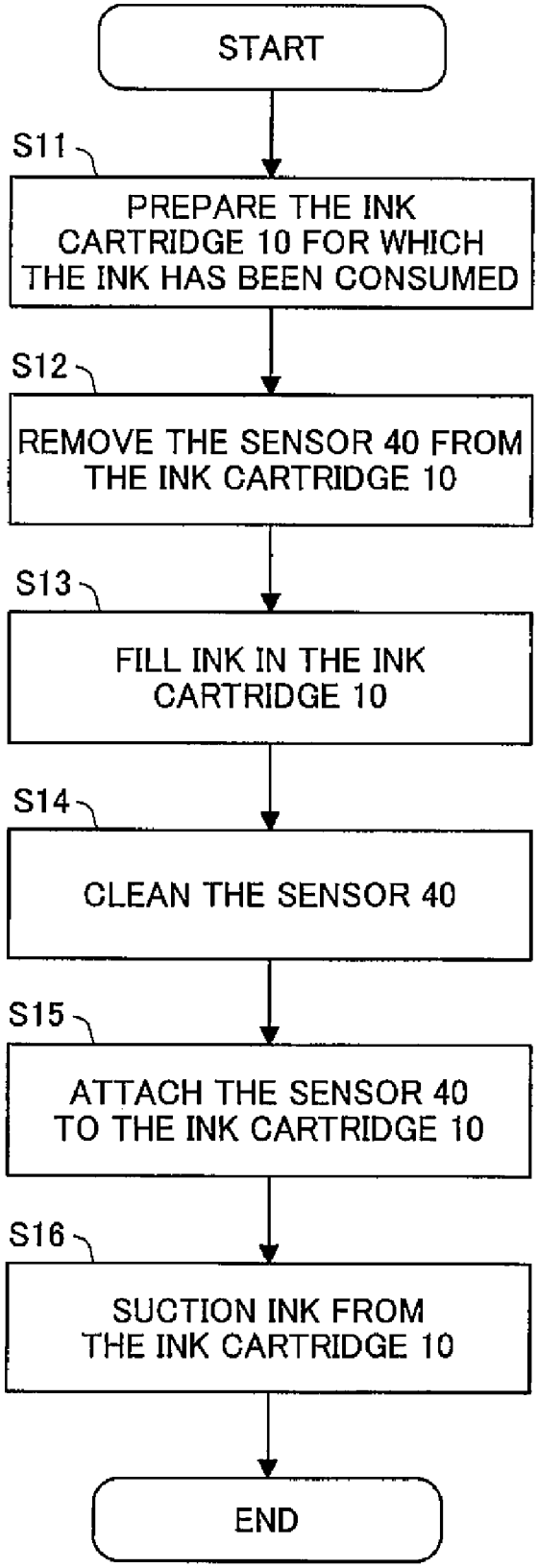
FIG. 3 is a flow chart showing the procedure of the ink liquid container manufacturing method of the first embodiment.
Figure 4:
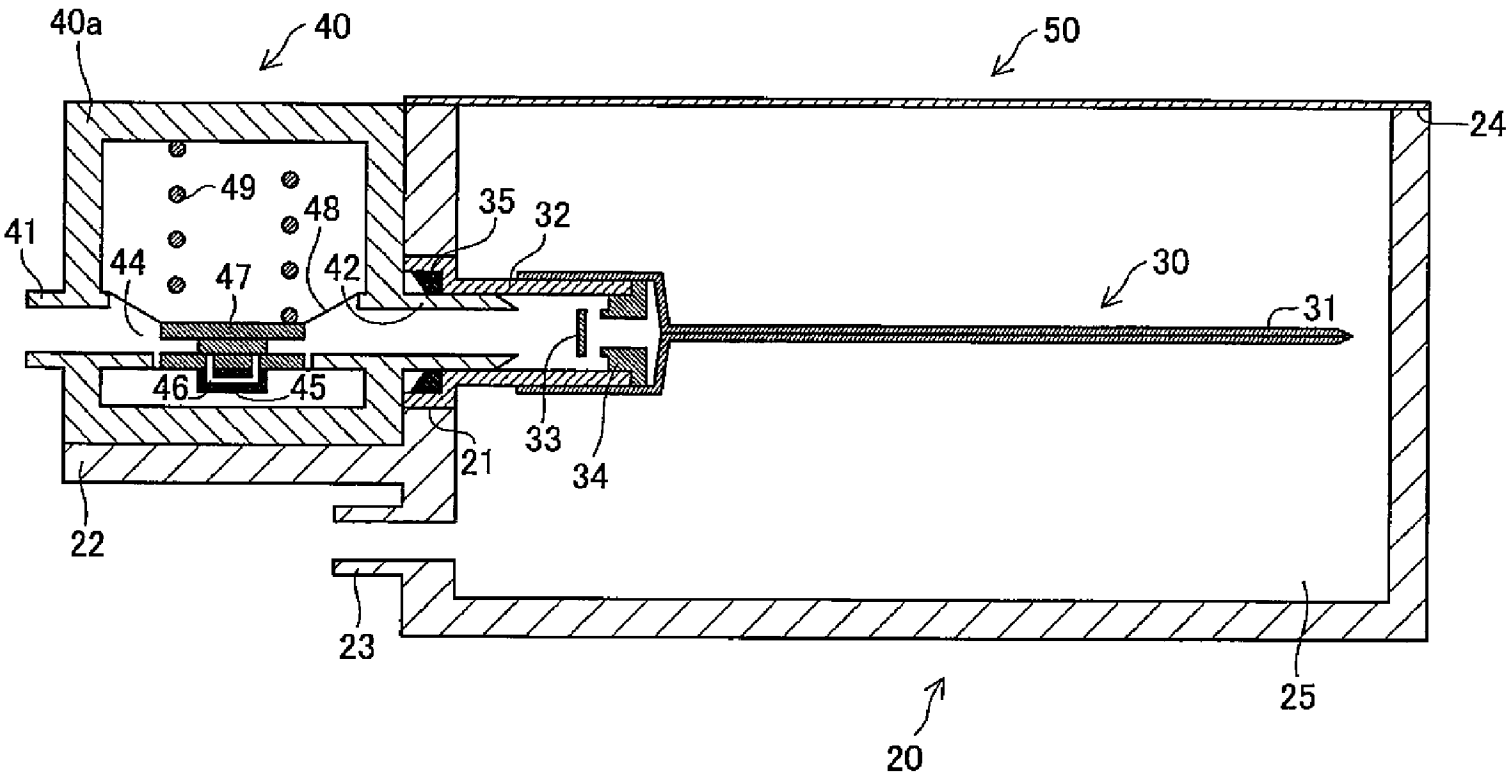
FIG. 4 is an explanatory drawing showing the state of the ink cartridge with the ink consumed.

The ink cartridge manufacturing method of the first embodiment will now be described. FIG. 3 is a flow chart showing the process of the ink filling method for the ink cartridge manufacturing method of the first embodiment. To fill ink in the ink cartridge 10, first, the ink cartridge 10 for which the ink has been consumed is prepared (step S11). FIG. 4 is an explanatory drawing showing the state of the ink cartridge with the ink consumed. With the ink cartridge 10, the ink housed in the ink pack 30 is consumed by being supplied to the printer. The ink inside the ink pack 30 does not have to be completely consumed.

Figure 5:
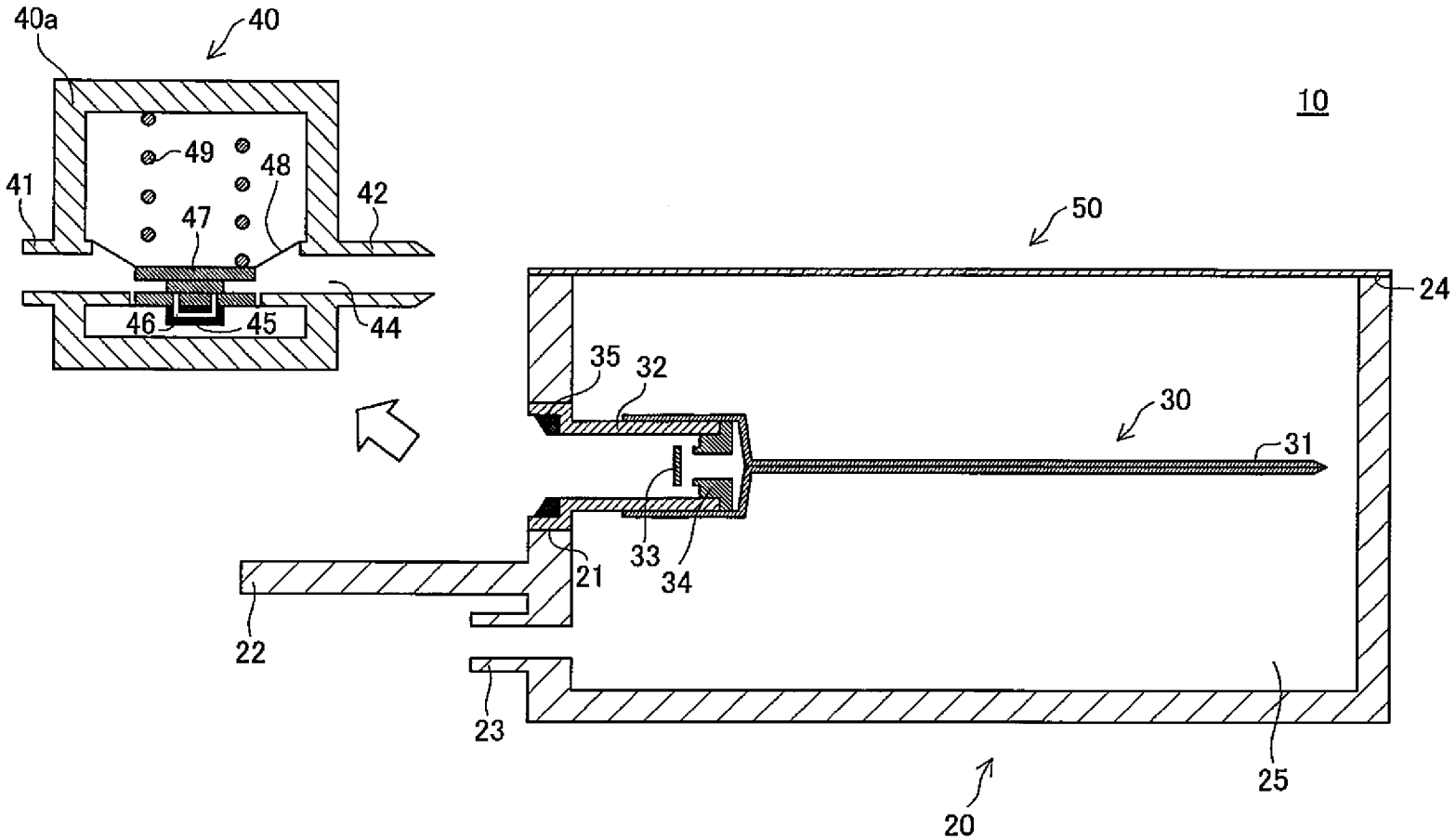
FIG. 5 is an explanatory drawing showing the state with the sensor removed from the ink cartridge.

After the ink cartridge 10 for which the ink has been consumed is prepared, removal of the sensor 40 from the ink cartridge 10 is performed (step S12). FIG. 5 is an explanatory drawing showing the state with the sensor removed from the ink cartridge. Removal of the sensor 40 can be implemented by releasing the connection between the sensor fixing unit 22 and the sensor case 40*a* and by releasing the connection between the discharge unit 32 and the introduction port 42.

Figure 6:
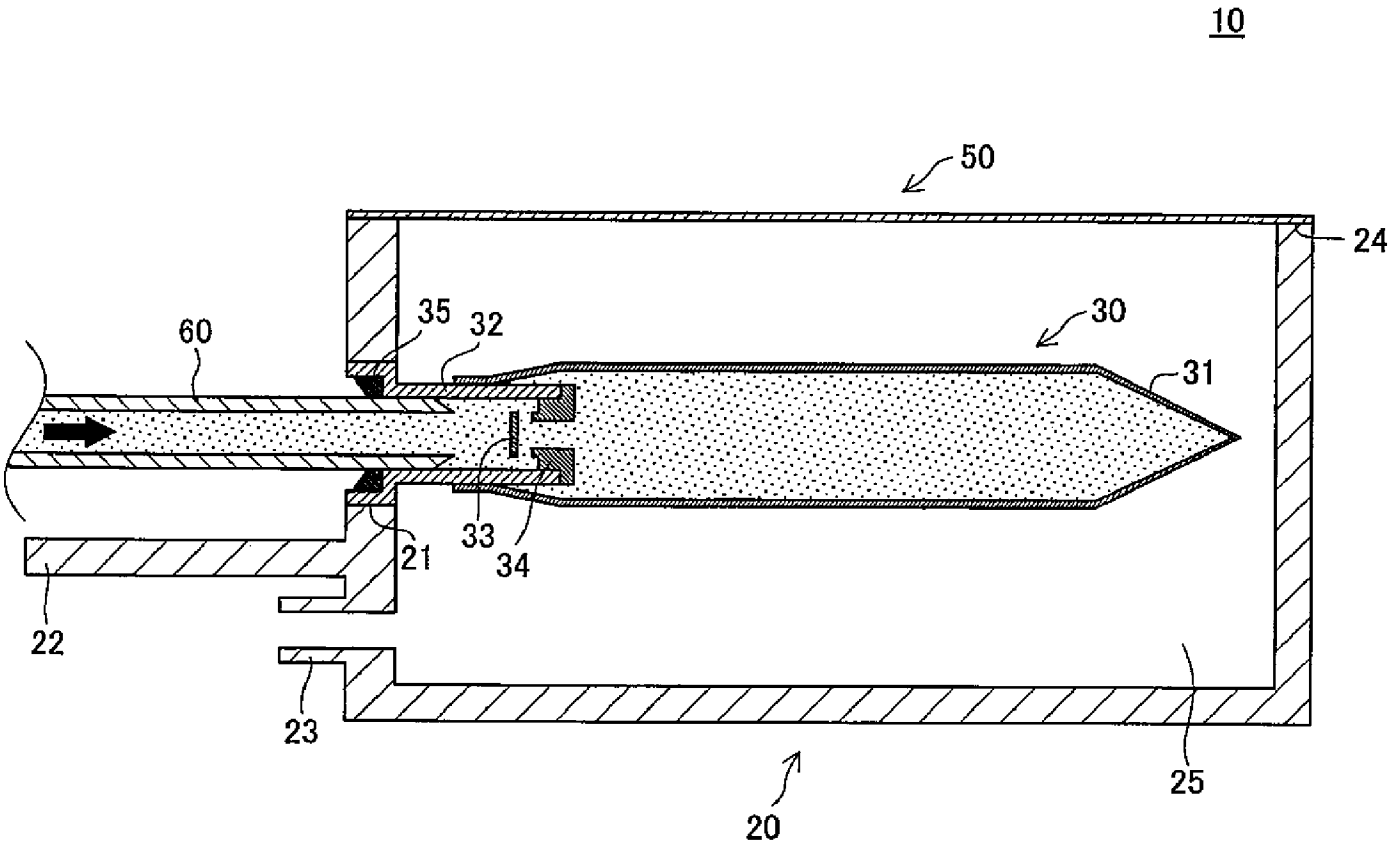
FIG. 6 is an explanatory drawing showing the state of ink being filled in the ink cartridge.

After the sensor 40 is removed from the ink cartridge 10, filling of the ink into the ink cartridge 10 is performed (step S13). FIG. 6 is an explanatory drawing showing the state of ink being filled in the ink cartridge. A filling port 60 is an ink discharge port provided on the supply device capable of supplying ink to the outside. The shape of the filling port 60 is roughly the same shape as the introduction port 42 of the sensor 40. The filling port 60 is connected to the discharge unit 32 of the ink cartridge 10 for which the sensor 40 is removed. Ink is flowed in from the filling port 60 to the bag 31.

When charging ink, it is possible to have contact between the return check valve 33 and the valve seat 34 and to block the inflow of ink. However, it is possible to have the ink flow in to the bag 31 before there is contact by the return check valve 33 with the valve seat 34 by adjusting the pressure of the ink inflow, changing the installation angle of the discharge unit 32 when filling the ink, or shaking the ink being filled.

After the ink is charged into the ink cartridge 10, cleaning of the sensor 40 is performed (step S14). The sensor 40 has been removed from the ink cartridge 10. The cleaning of the sensor 40 is implemented by cleaning the liquid flow path 44 and the liquid detector path 46 that compose an ink flow path. The cleaning can be performed by inflowing liquid from the introduction port 42 or the lead-out port 41; or a suction means (suction device) or pressurization means (pressurization device) can be connected to the introduction port 42 or the lead-out port 41, and the ink remaining in the liquid flow path 44 and the liquid detection path 46 can be removed using suction or pressure feed.

With this embodiment, the sensor 40 is cleaned after the ink is filled into the ink cartridge 10, but as long as it is after the sensor 40 is removed from the ink cartridge 10, it is also possible to implement cleaning before filling of the ink to the ink cartridge 10 or during filling.

Figure 7:
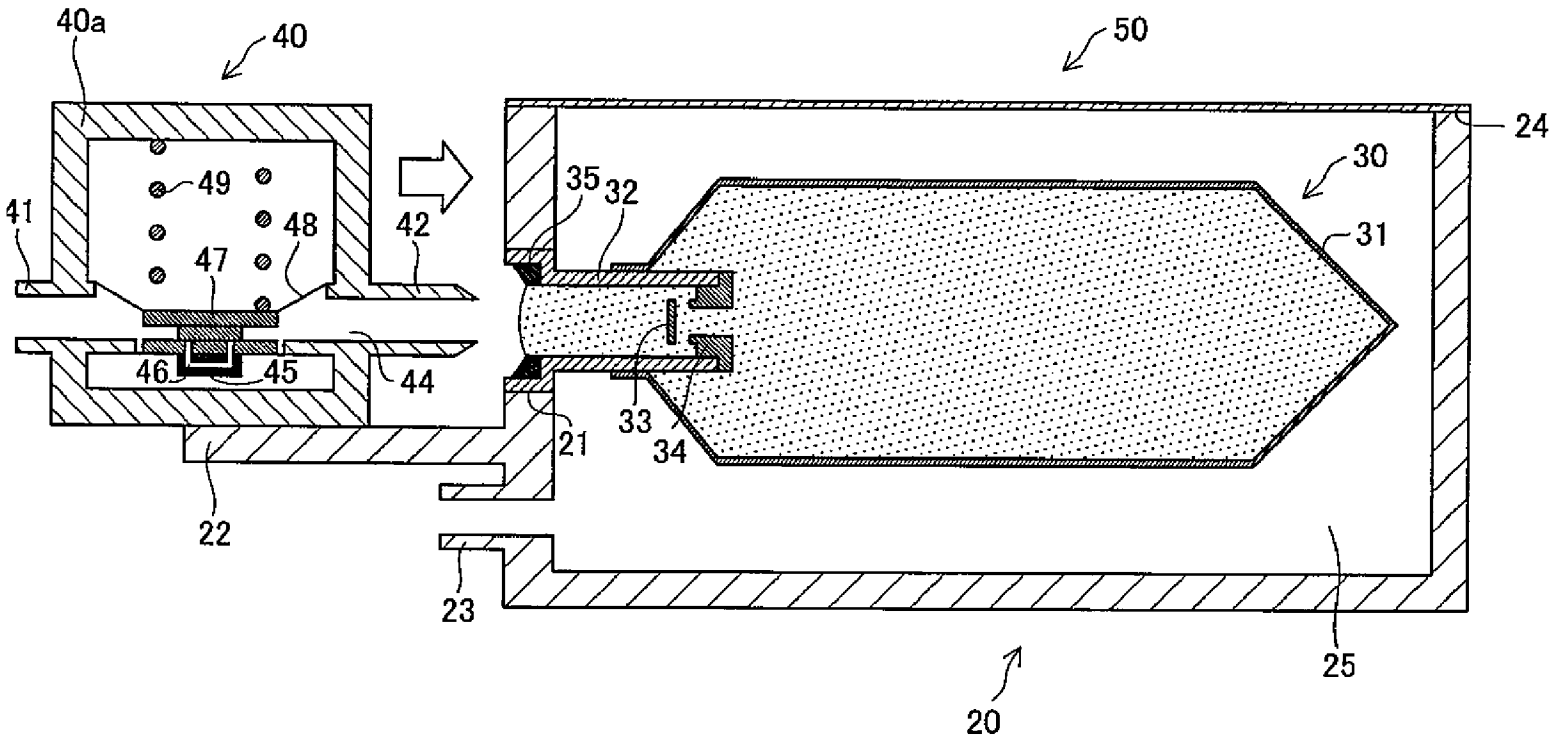
FIG. 7 is an explanatory drawing showing the state with the sensor attached to the ink cartridge.

The sensor 40 after cleaning is attached to the ink cartridge 10 filled with ink (step S15). FIG. 7 is an explanatory drawing showing the state with the sensor attached to the ink cartridge. The discharge unit 32 of the ink pack 30 filled with ink and the introduction port 42 of the sensor 40 for which cleaning is finished are connected to the bag 31. Also, the sensor case 40*a* is fixed to the sensor fixing unit 22, and the sensor 40 is attached to the ink cartridge 10.

Figure 8:
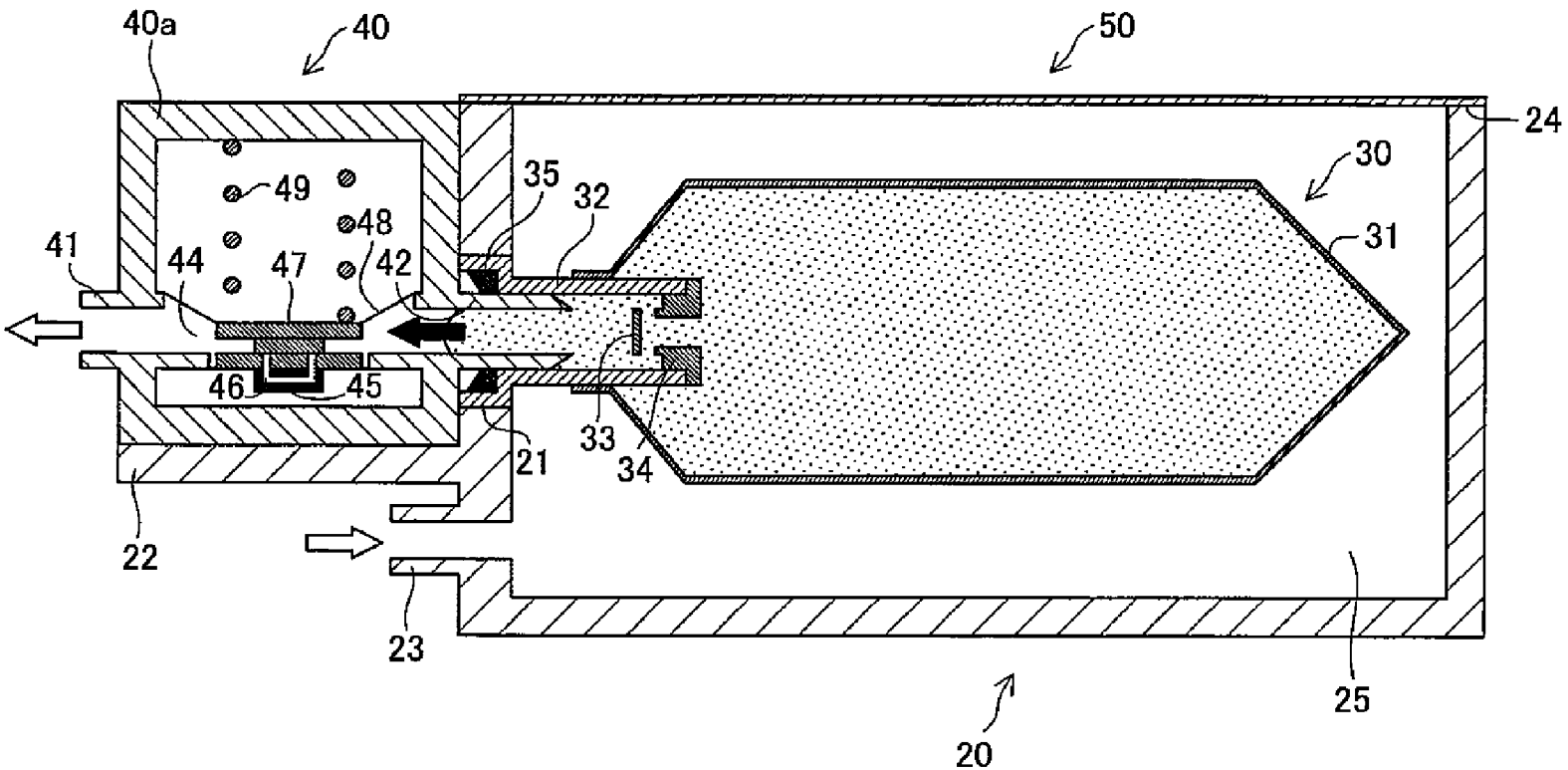
FIG. 8 is an explanatory drawing showing the state with ink suctioned from the ink cartridge.

After the sensor 40 is fixed to the ink cartridge 10, suction of the ink from the ink cartridge 10 is performed (step S16). FIG. 8 is an explanatory drawing showing the state with ink suctioned from the ink cartridge. A suction device (not illustrated) is connected to the lead-out port 41 of the ink cartridge 10. By performing suction using the suction device, the interiors of the liquid flow path 44 and the liquid detection path 46 are set to negative pressure, and the ink housed in the ink pack 30 is flowed in to the liquid flow path 44 and the liquid detection path 46.

In addition to the manner of this embodiment for inflow of ink to the liquid flow path 44 an the liquid detection path 46, it is also possible to implement this by injection of air inside the pressurization chamber 25 using a pressurization means from the pressurization port 23 and discharging ink from the ink pack 30. It is also possible to simultaneously implement suction from the lead-out port 41 and the injection of air from the pressurization port 41.

The ink that inflows to the liquid flow path 44 and the liquid detection path 46 is heated to a specified temperature to lower the viscosity. Heating of the ink can be carried out before attachment of the sensor 40 to the storage container 20, and can also be carried out after attachment, as long as it is before the inflow of ink to the liquid flow path 44 and the liquid detection path 46.

The inflow of ink to the liquid flow path 44 and the liquid detection path 46 is executed until the volume of ink inside the ink pack 30 reaches a specified volume. When there is inflow of ink at greater than the capacity that can be received inside the liquid flow path 44 and the liquid detection path 46, the ink is discharged from the lead-out port 41.

With the liquid container manufacturing method of the first embodiment described above, even in a case of charging ink to the ink cartridge 10 equipped with the sensor 40, the ink is charged with the sensor 40 removed from the ink cartridge 10, so it is possible to reduce the occurrence of problems with the sensor 40 due to ink filling. The liquid container manufacturing method of the first embodiment can also be called a method of filling a liquid (ink) in a liquid container.

With the liquid container manufacturing method of the first embodiment, because the ink is filled into the ink pack 30 after the sensor 40 connected to the ink pack 30 is removed, even when filling ink for reuse of the ink cartridge 10, it is possible to reduce the occurrence of problems with the sensor 40 due to ink filling.

With the liquid container manufacturing method of the first embodiment, it is possible to fill ink into the ink cartridge 10 for which the opening 24*a* for storing the ink pack 30 in the storage container 20 is closed by the flexible member 50.

With the liquid container manufacturing method of the first embodiment, it is possible to eliminate air bubbles inside the liquid flow path 44 and the liquid detection path 46 by inflowing ink housed in the ink pack 30 to the liquid flow path 44 and the liquid detection path 46 using a suction device. By doing this, it is possible to reduce the decrease in function of the sensor 40, and it is possible for the ink cartridge 10 to supply ink with stability.

With the liquid container manufacturing method of the first embodiment, the inflow of ink to the liquid flow path 44 and the liquid detection path 46 is implemented until the volume of ink inside the ink pack 30 reaches a specified volume, so it is possible to maintain the suitability of the volume of liquid received by the ink pack 30, and in addition to reducing the variation of the ink for each ink pack 30, it is also possible to implement suitable ink discharge by suppressing the ink within the ink pack 30 to an allowed holding capacity range.

With the liquid container manufacturing method of the first embodiment, by cleaning the liquid flow path 44 and the liquid detection path 46 before attaching the sensor 40 to the storage container 20, it is possible to eliminate air bubbles inside the liquid flow path 44 and the liquid detection path 46.

By doing this, it is possible to reduce the decrease in function of the sensor 40, and possible for the ink cartridge 10 to supply ink with stability.

With the liquid container manufacturing method of the first embodiment, the ink flowed in to the liquid flow path 44 and the liquid detection path 46 is heated to a specified temperature, the ink viscosity is lowered, and not only is it easier to inflow to the liquid flow path 44 and the liquid detection path 46, but it is also possible to reduce the occurrence of air bubbles due to inflow.

Second Embodiment

In the first embodiment, the method of manufacturing the ink container (ink cartridge) for filling ink to reuse the ink cartridge 10 for which the ink has been consumed is described. Specifically, a case of a manufacturing method (regenerating method) for reusing the liquid container is explained. As the second embodiment, we will describe an example of applying this when manufacturing the ink cartridge 10.

Figure 9:
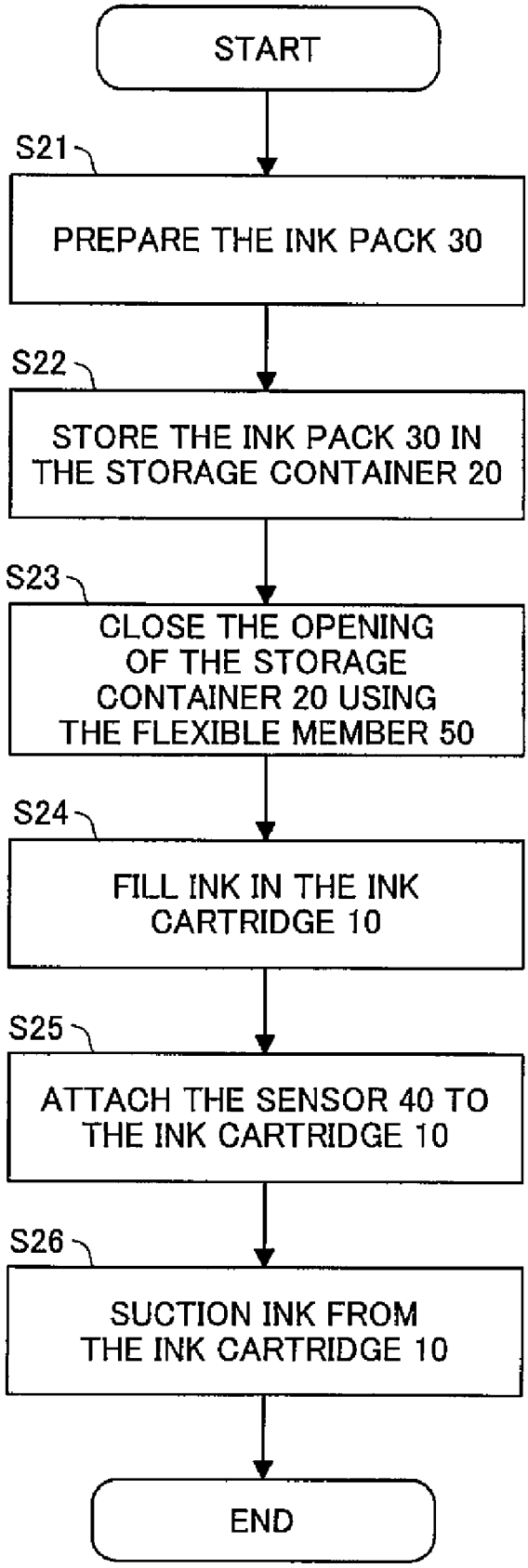
FIG. 9 is a flow chart showing the procedure of the ink cartridge manufacturing method of the second embodiment.

The schematic structure of the ink cartridge of the second embodiment is the same structure as the ink cartridge of the first embodiment, so its description is omitted here. Here, the method of manufacturing the ink cartridge of the second embodiment will be described. FIG. 9 is a flow chart showing the procedure of the ink cartridge manufacturing method of the second embodiment. To manufacture the ink cartridge 10, first, the ink pack 30 which is not filled with ink is prepared (step S21). The ink pack 30 can be newly manufactured, or it can be a used item. In the case of a used item, the ink does not have to be completely consumed.

Figure 10:
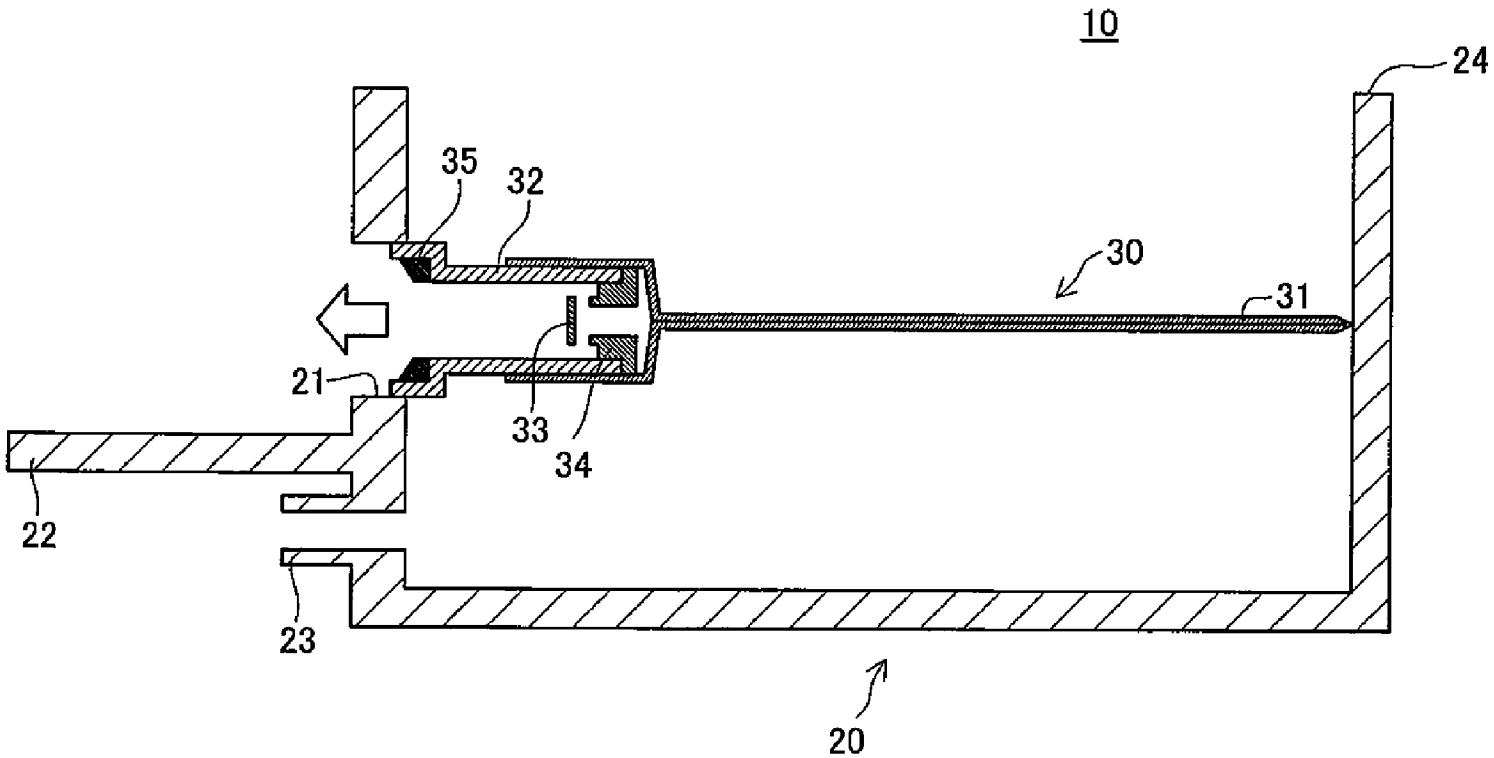
FIG. 10 is an explanatory drawing showing the state of the ink pack stored in the storage container.

The ink pack 30 is stored in the storage container 20 (step S22). FIG. 10 is an explanatory drawing showing the state of the ink pack stored in the storage container. To store the ink pack 30, first, a storage container 20 equipped with an opening 24*a* is prepared. The storage container 20 can be newly manufactured or it can be a used item. The prepared ink pack 30 is introduced inside the storage container 20 from the opening 24*a* of the storage container 20, and is engaged with the pass-through port 21 and the discharge unit 32.

The opening 24*a* of the storage container 20 in which the ink pack 30 is stored is closed using the flexible member 50 (step S23). The flexible member 50 is prepared, the opening edge 24 is heat welded, and the opening 24*a* is closed. As long as it is after the ink pack 30 is stored in the storage container 20, the closing of the opening 24*a* can be after the ink filling described later or it can be after the attachment of the sensor 40.

The ink cartridge 10 is filled with ink (step S24). The same as with embodiment 1, the filling port 60 is connected to the discharge unit 32, and filling of the ink into the ink cartridge 10 is performed by inflowing ink to the bag 31. The explanatory drawing of filling the ink in the ink cartridge 10 is as shown in FIG. 6.

The sensor 40 is attached to the ink cartridge 10 (step S25). As in the first embodiment, the discharge unit 32 of the ink pack 30 for which ink is filled in the bag 31 and the introduction port 42 of the sensor 40 are connected, and the sensor case 40*a* is fixed to the sensor fixing unit 22. The explanatory drawing of the attachment of the sensor 40 to the ink cartridge 10 is as shown in FIG. 7.

Ink is suctioned from the ink cartridge 10 (step S26). As in the first embodiment, suction is performed by a suction device (not illustrated) at the lead-out port 41 of the ink cartridge 10, and the ink housed in the ink pack 30 is flowed in to the liquid flow path 44 and the liquid detection path 46. The explanatory drawing of ink being suctioned from the ink cartridge 10 is as shown in FIG. 8.

With the manufacturing method of the second embodiment described above, even during manufacturing of the ink cartridge 10 equipped with the sensor 40, the sensor 40 is attached after the ink is filled in the ink pack 30, so it is possible to manufacture liquid containers with a reduction in the occurrence of problems with the sensor 40 due to ink filling.

With the method of manufacturing the ink cartridge of the second embodiment, the ink pack 30 is stored in the storage container 20, and for the ink cartridge 10 for which the opening 24*a* is closed using the flexible member 50, it is possible to manufacture this with a reduction in the occurrence of problems with the sensor 40.

With the ink cartridge manufacturing method of the second embodiment, the effects of inflowing ink housed in the ink pack 30 to the liquid flow path 44 and the liquid detection path 46, having the ink volume inside the ink pack 30 be a specified volume, and heating the ink to a specified temperature, are the same as those of the first embodiment.

Example of Using the Ink Cartridge of the Embodiment

Figure 11:
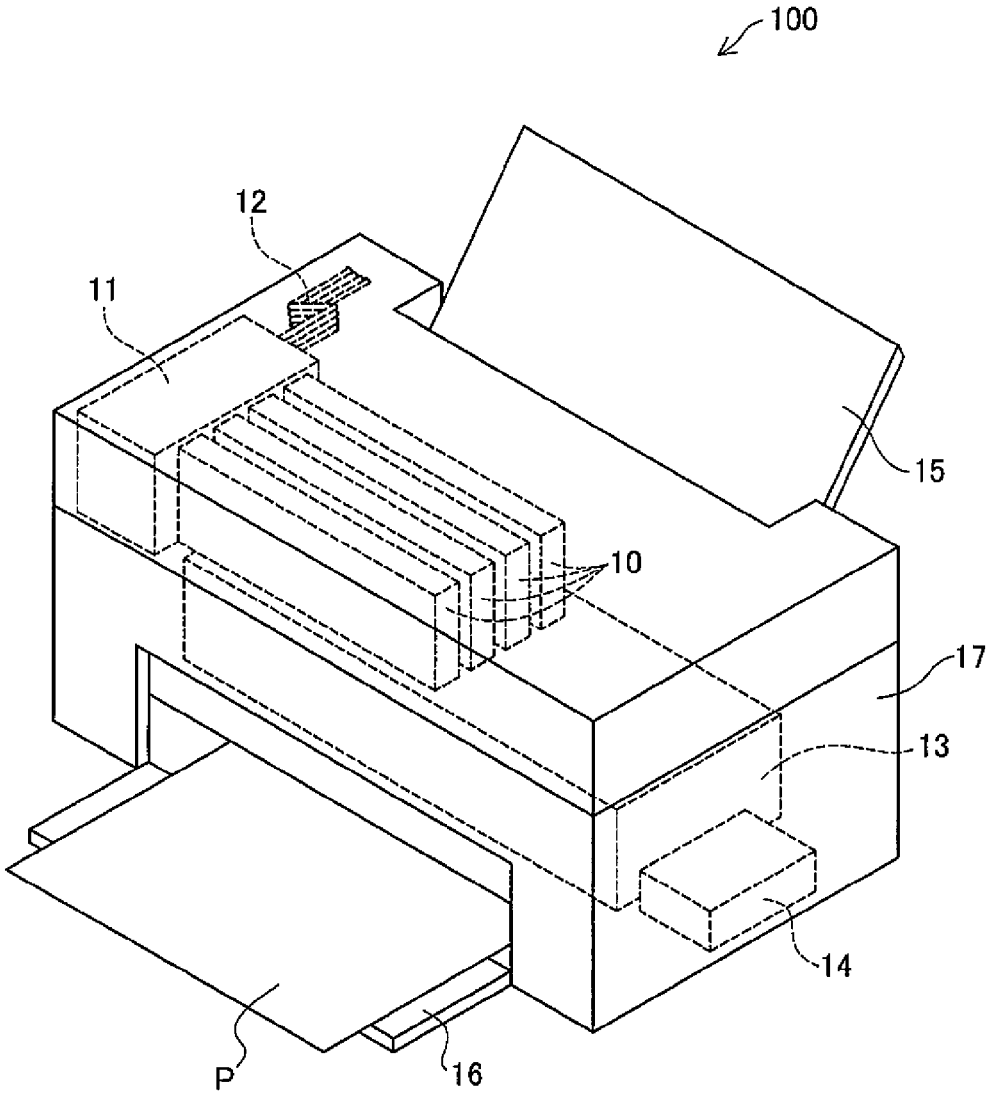
FIG. 11 is an explanatory drawing showing the schematic structure of a printer using the ink cartridge.

An example of using the ink cartridge 10 obtained using the manufacturing method of this embodiment will now be described. FIG. 11 is an explanatory drawing showing the schematic structure of a printer using the ink cartridge. The printer 100 is an inkjet printer that records text or graphics by spraying ink drops on printing paper P. The printer 100 is equipped with a paper supply tray 15, a paper ejection tray 16, and a case 17. The printer 100 introduces printer paper P inside the case 17 from the paper tray 15, sprays ink drops on a printing mechanism 13 inside the case 17, and ejects the printing paper P on which text or graphics are recorded from the paper ejection tray 16 to outside the case 17.

The case 17 has stored inside it the ink cartridge 10 of this embodiment, an ink supply unit 11, a supply tube 12, the printing mechanism 13, and a control unit 14. The ink cartridges 10 house inside them respectively black, cyan, magenta, and yellow ink. Each color ink cartridge 10 is connected to the ink supply unit 11. As another embodiment, it is also possible to connect four or more colors of ink cartridge 10 to the ink supply unit 11 with a printer that performs printing with four or more colors of ink.

The ink supply unit 11 has the ink cartridge 10 and the supply tube 12 connected. The connected ink cartridge 10 receives the supply of ink, and supplies ink to the printing mechanism 13 via the supply tube 12. The printing mechanism 13 incorporates a spray head (not illustrated), and is equipped with a carriage (not illustrated) connected to the supply tube 12. The carriage is moved by a motor (not illustrated), and spraying of the ink drops on the printing paper P is performed from the spray head. The control unit 14 controls each part of the printer 100, and also is electrically connected to the integrated circuit substrate 43 of the ink cartridge 10, and receives information regarding the remaining volume of ink.

Modified Embodiments

It is to be understood that the present invention can be embodied in various modes other modes without departing from the scope and spirit thereof.

Modified Embodiment 1

Figure 12:
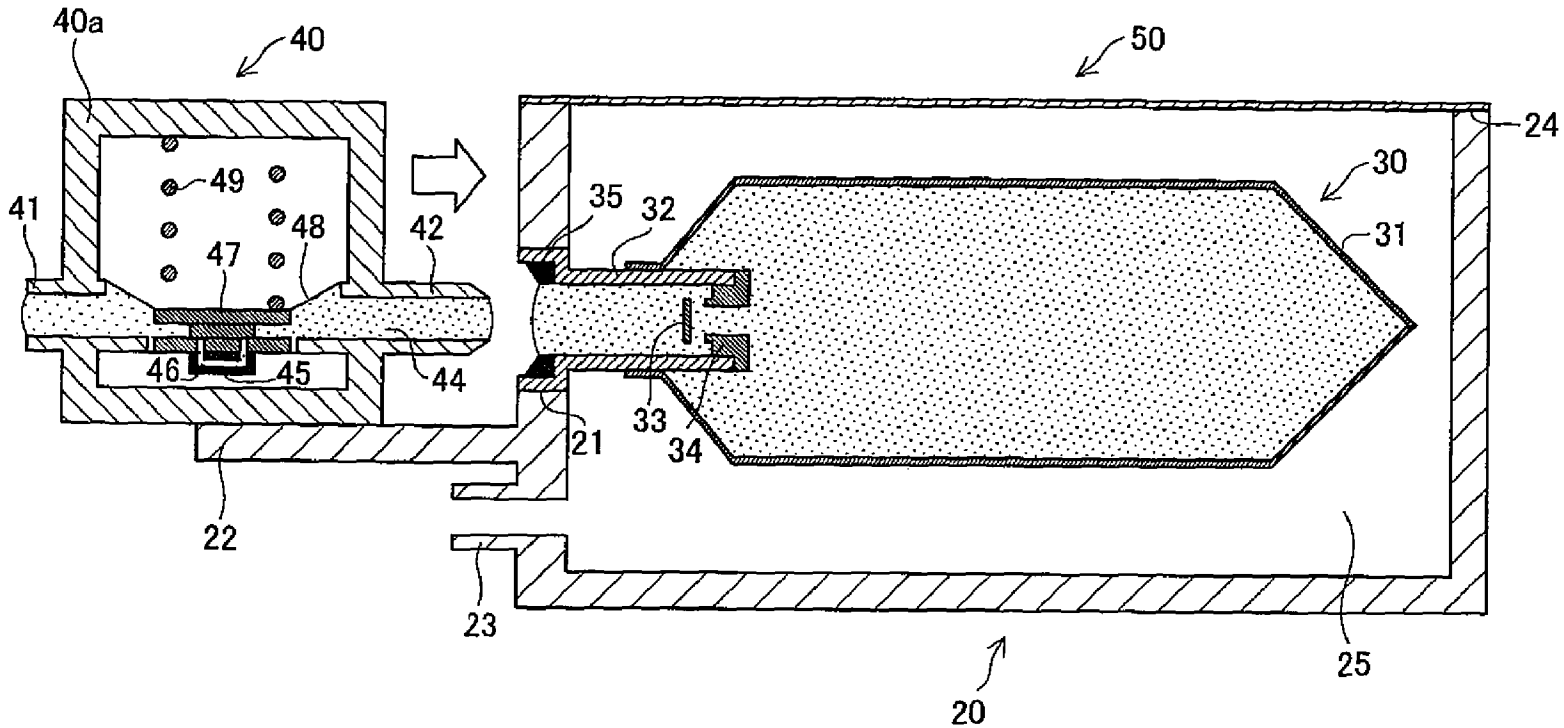
FIG. 12 is an explanatory drawing showing a variation example of attaching a sensor to the ink cartridge.

FIG. 12 is an explanatory drawing showing a variation example of attaching a sensor to the ink cartridge. With this embodiment, the sensor 40 in a state for which ink is not filled inside the liquid flow path 44 and the liquid detection path 46 is connected with the ink pack 30, but it is also possible to add a step of filling ink inside the liquid flow path 44 and the liquid detection path 46 in advance before connecting with the ink pack 30, and to connect the sensor 40 filled with ink to the ink pack 30. Also, when filling ink in the sensor 40, it is also possible to fill ink that has been heated to a specified temperature.

Modified Embodiment 2

In the ink cartridge 10 of this embodiment, the opening 24*a* of the storage container 20 is closed off with the flexible member 50, but it is also possible to use a material that is not flexible, as long as it is possible to form an airtight pressurization chamber 25.

Modified Embodiment 3

The ink cartridge 10 of this embodiment is equipped with a return check valve at the discharge unit 32 of the ink pack 30, but it is also possible to constitute the ink pack 30 without the return check valve.

Modified Embodiment 4

In this embodiment, the ink charged to the ink pack 30 was heated and introduced to the sensor 40, but it is also possible to heat the ink charged to the ink cartridge 10 to a specified temperature in advance and to introduce this to the ink pack 30.

Modified Embodiment 5

In the first embodiment, after cleaning the sensor 40 which was removed from the storage container 20, it was reattached, but it is also possible to attach a different sensor 40 to the storage container 20 than the sensor 40 that was removed.

With the ink cartridge manufacturing methods according to the variation examples described above, it is possible to reduce the occurrence of air bubbles inside the liquid flow path 44 and the liquid detection path 46 by connecting the sensor 40 for which ink is filled inside the liquid flow path 44 and the liquid detection path 46 to the ink pack 30. By doing this, it is possible to reduce the decrease in functioning of the sensor 40, and it is possible for the ink cartridge 10 to supply ink with stability.

Also, if the discharge unit 32 of the ink pack 30 is not equipped with a return check valve, it is possible to easily fill with ink during filling of the ink to the ink pack 30 without blocking the inflow of ink by contact by the return check valve 33 with the valve seat 34.

Third Embodiment

The schematic structure of the ink cartridge which is the liquid container of the third embodiment will now be described. FIG. 13 is an explanatory drawing showing the schematic structure of the ink cartridge. The ink cartridge 10 is equipped with a cabinet unit 20, the ink pack 30, the liquid volume detector device 40, the sealing member 50, and a lid 60. With the ink cartridge 10 of this embodiment, the ink housed in the ink pack 30 which is the liquid receptacle is supplied to a printer (not illustrated) via the liquid volume detector device 40. In the following explanation, the same reference numbers used in the first or second embodiments are used.

Figure 13A:
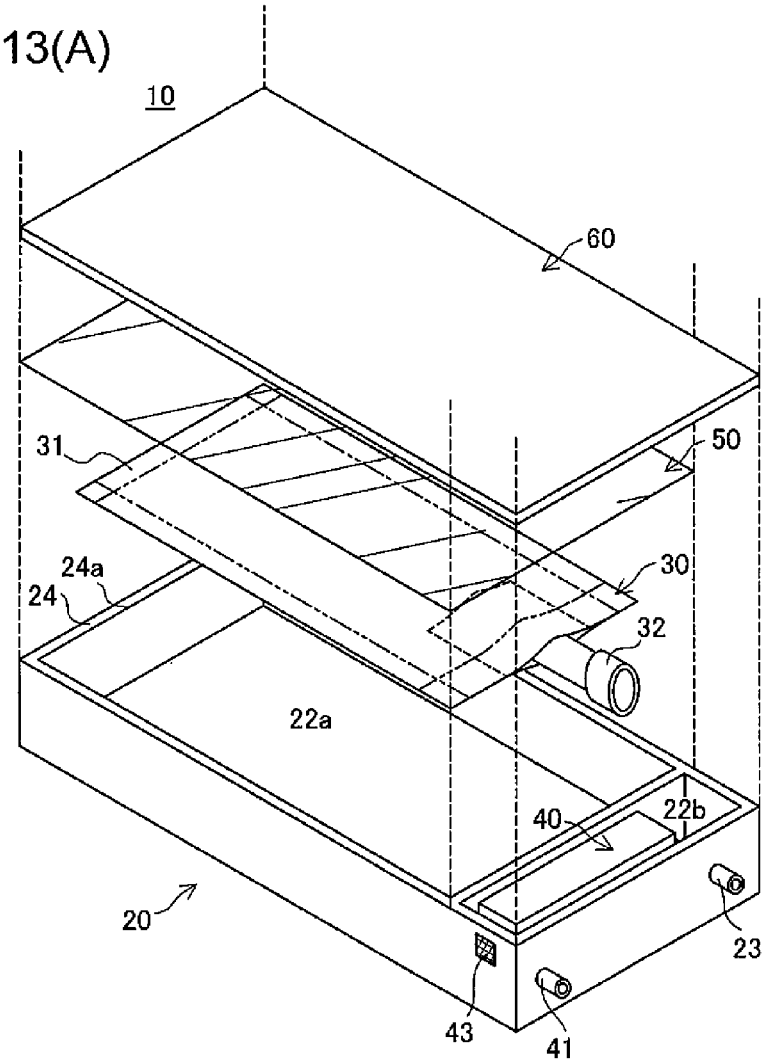
FIG. 13(A) and FIG. 13(B) are explanatory drawings showing the schematic structure of the ink cartridge of the third embodiment.
Figure 13B:
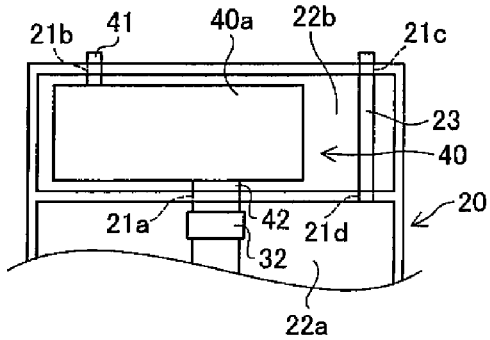

As shown in FIG. 13(A), the cabinet unit 20 has a roughly cabinet shape, and is equipped with two independent items, an ink receiver 22*a* and sensor receiver chamber 22*b*. The top surface of the ink receiving chamber 22*a* is equipped with the opening 24*a* formed by the opening edge 24. The cabinet unit 20 is formed by a thermoplastic resin such as polystyrene or the like. The cabinet unit 20 stores the ink pack 30 in the ink receiving chamber 22*a* from the opening 24*a*. As shown in FIG. 13(B), the cabinet unit 20 is equipped with a first opening 21*a*, a second opening 21*b*, a third opening 21*c*, and a fourth opening 21*d*. The first opening 21*a* and the fourth opening 21*d* link the ink receiving chamber 22*a* and the sensor receiving chamber 22*b*, and the second opening 21*b* and the third opening 21*c* link the sensor receiving chamber 22*b* and outside of the cabinet unit 20. The first opening 21*a* is used to connect the ink pack 30 and the liquid volume detector device 40. The second opening 21*b* is used to discharge the ink inside the liquid volume detector device 40 to outside the cabinet unit. The third opening 21*c* and the fourth opening 21*d* are used to arrange a pressurization tube 23 for supplying pressurized air to the ink receiving chamber 22*a* from outside the cabinet unit.

The ink pack 30 is equipped with the bag 31 and the discharge unit 32. The ink pack 30 receives ink inside the bag 31, and the ink received from the discharge unit 32 is discharged to outside the ink pack 30. The bag 31 is formed by pasting together the peripheral edge parts of the aluminum laminate multi layer film formed by lamination of aluminum layers on the resin film layer. The discharge unit 32 has a roughly round cylinder shape, is connected via the first opening 21*a* to the introduction port 42 that the liquid volume detector device 40 described later is equipped with, and the ink housed in the bag 31 is led-out to the liquid volume detector device 40.

The liquid volume detector device 40 performs detection of the remaining volume of ink housed in the ink pack 30. The liquid volume detector device 40 is equipped with a sensor case 40*a*, a lead-out port 41, and an introduction port 42. The liquid volume detector device 40 introduces the ink housed in the ink pack 30 from the introduction port 42, and discharges it from the lead-out port 41 connected to the printer via the inside of the sensor case 40*a*. With this embodiment, the liquid volume detector device 40 is equipped with a function of detecting the remaining volume of ink inside the ink pack 30, but in addition, it is also possible to be equipped with a function of detecting the ink consumption volume consumed by the printer, the flow volume of ink that posses through the flow path of the liquid volume detector device 40, or the pooled ink volume housed in the ink receptor. The integrated circuit substrate 43 is fixed to the side surface of the cabinet unit 20 so as to be electrically connected to the liquid volume detector device 40, and provides information relating to the remaining volume of ink inside the ink pack 30 detected by the liquid volume detector device 40 to the printer (not illustrated).

The sealing member 50 is a flexible film for which one surface is constituted by a junction material 52 made from the same material as the cabinet unit 20, such as polystyrene, for example, and the other is constituted by a surface material 51 made from the polyethylene terephthalate of the backing member. The sealing member 50 is welded to the opening edge 24 of the cabinet unit 20, and the opening 24*a* is sealed. The welding can be implemented through heat fusion of the junction material 52 in a state facing opposite the surface made from the junction material 52 at the side of the surface in contact with the opening edge 24. Adhesion of the sealing member 50 and the opening edge 24 can be accomplished not only by heat bonding as taught in this embodiment, but can also be accomplished using ultrasonic welding, vibration bonding, or adhesion using an adhesive agent.

Figure 14:
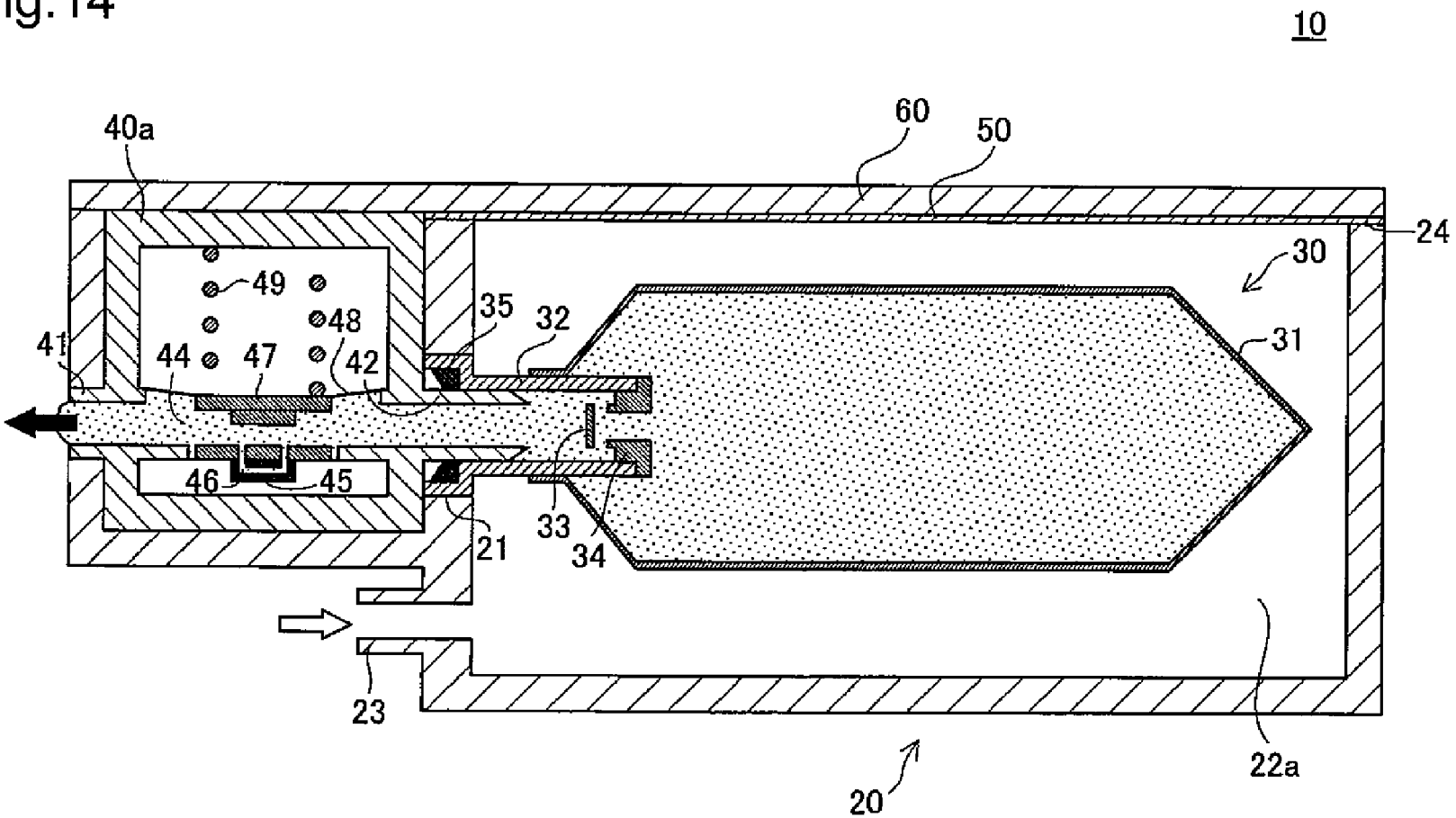
FIG. 14 is an explanatory drawing showing the schematic structure of the cross section of the ink cartridge of the third embodiment.

FIG. 14 is an explanatory drawing showing the schematic structure of the cross section of the ink cartridge. The ink receiving chamber 22*a* in which the ink pack 30 is stored is made airtight by the sealing member 50, and liquid cannot go out or in other than from the pressurization tube 23. By injecting gas inside the ink receiving chamber 22*a* from the pressurization tube 23, the ink pack 30 is compressed, and the ink housed in the ink pack 30 is discharged.

The ink pack 30 is equipped with the return check valve 33, the valve seat 34, and the packing 35 on the discharge unit 32. The return check valve 33 is a roughly plate shaped valve unit with roughly the same shape as the inside cross section of the discharge unit 32. The return check valve 33 can separated from the valve seat 34 by the ink flow dynamics and discharge ink when discharging ink housed in the bag 31 to outside the bag 31, but when inflowing ink to the bag 31, it functions so as to contact the valve seat 34 by the flow dynamics in the opposite direction from those during discharging, which blocks the inflow of ink. The packing 35 forms a ring shape on the inside of the discharge unit 32, and when the discharge unit 32 connects with the introduction port 42, by filling in the gap, outflow of ink to outside from the connection part is prevented.

The sensor case 40*a* is equipped with the liquid flow path 44, the piezoelectric vibrating component 45, the liquid detection path 46, the bearing plate 47, the diaphragm 48, and the spring 49. The bearing plate 47 rises and falls in resistance to the bias of the spring 49 according to the volume of ink that flows through the liquid flow path 44 formed by the diaphragm 48 and the bearing plate 47. By rising and falling operation of the bearing plate 47, the shape and capacity of the liquid flow path 44 that contacts the vibrating plate of the piezoelectric vibrating component 45 changes, and the back electromotive force generated at the piezoelectric vibrating component 45 changes. The presence or absence of ink is determined by the printer by outputting this back electromotive force information to the printer via the integrated circuit substrate 43.

Figure 15:
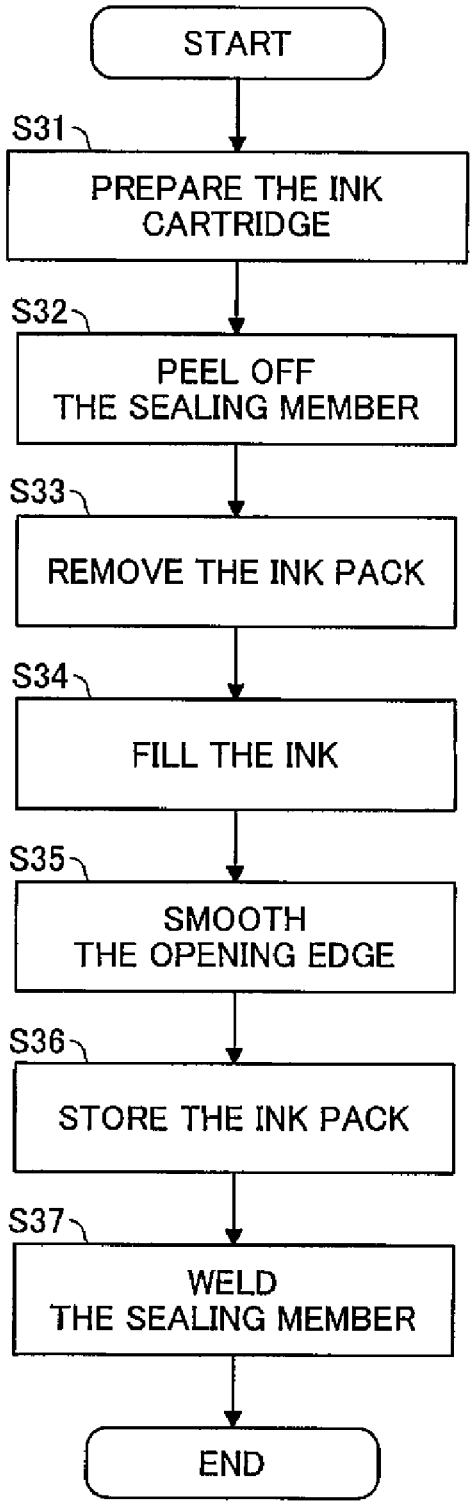
FIG. 15 is a flow chart showing the procedure of the ink liquid container manufacturing method of the third embodiment.
Figure 16:
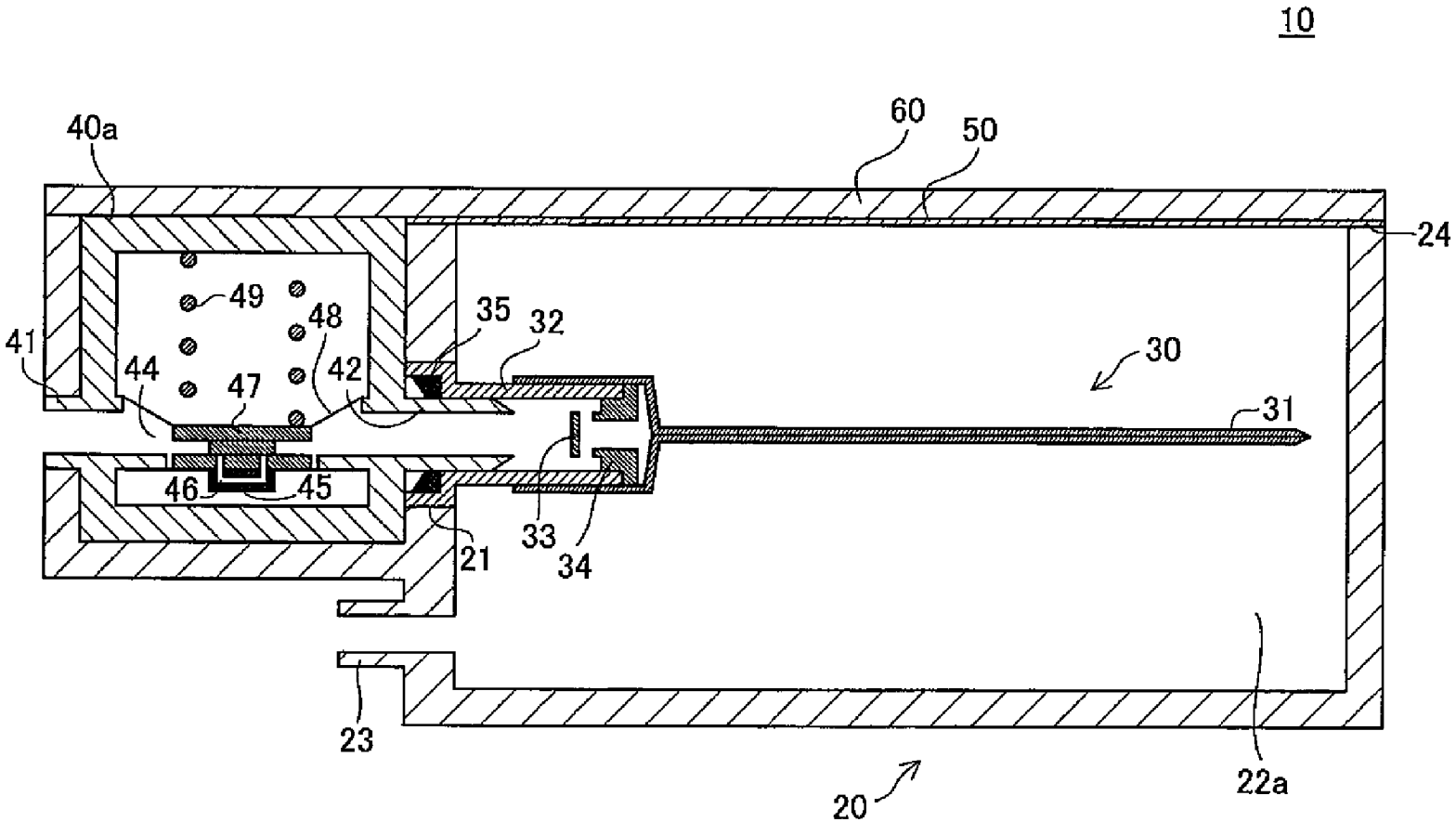
FIG. 16 is an explanatory drawing showing the state of the ink cartridge with the ink consumed.

The ink cartridge manufacturing method (ink cartridge regenerating method) of the third embodiment will now be described. FIG. 15 is a flow chart showing the process of the ink filling method for the ink cartridge manufacturing method of the third embodiment. To implement filling of ink in the ink cartridge 10, first, the ink cartridge 10 for which the ink has been consumed is prepared (step S31). FIG. 16 is an explanatory drawing showing the state of the ink cartridge with the ink consumed. As shown in FIG. 16, for the ink cartridge 10, an item was prepared for which the ink housed in the ink pack 30 is consumed by being supplied to the printer. The ink inside the ink pack 30 also does not have to be completely consumed.

Figure 17:
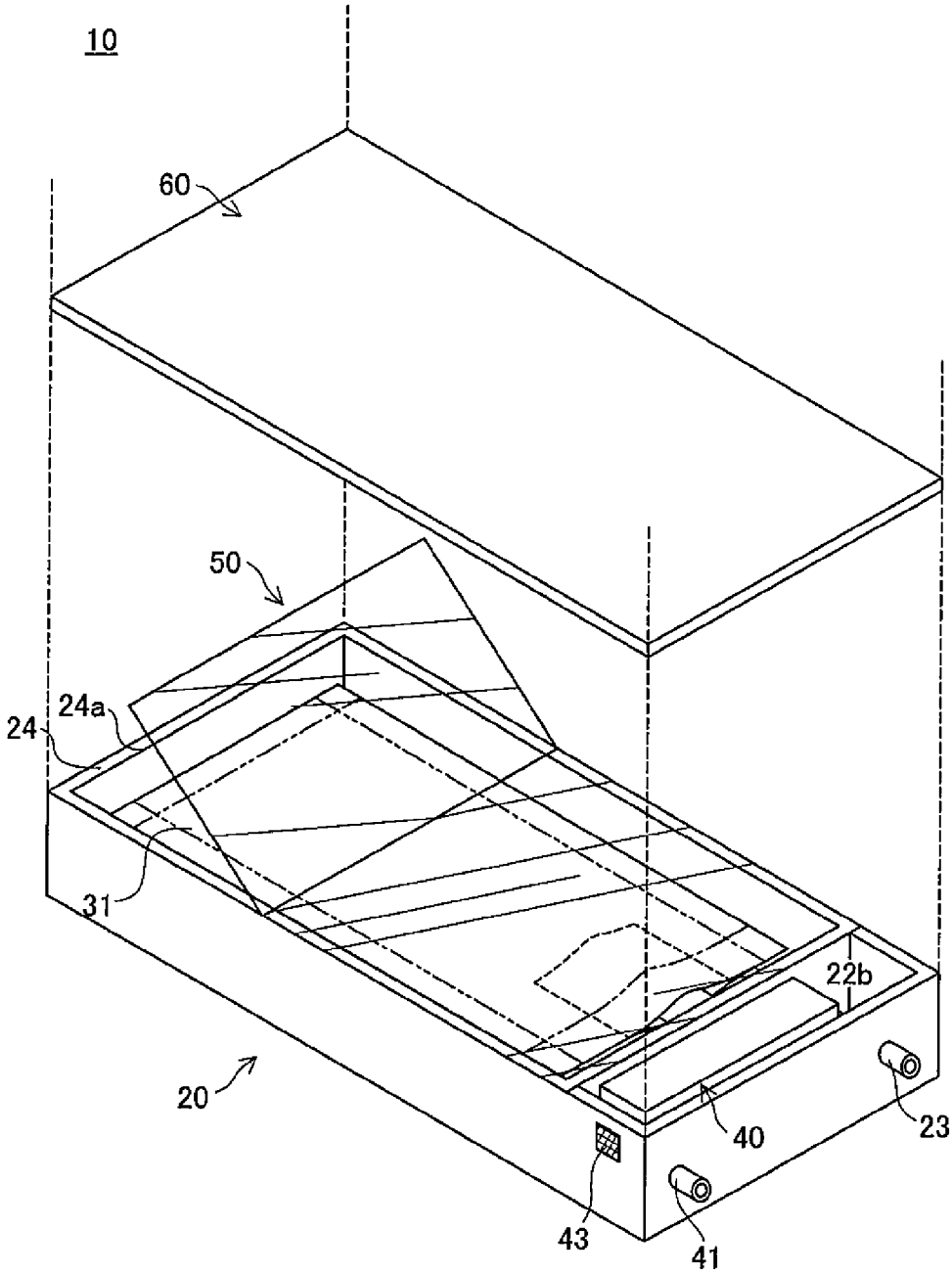
FIG. 17 is an explanatory drawing showing the state with the sealing member peeled from the ink cartridge.

The lid 60 of the prepared ink cartridge 10 is removed, and the sealing member 50 is peeled off (step S32). FIG. 17 is an explanatory drawing showing the state with the sealing member peeled from the ink cartridge. As shown in FIG. 17, after removing the lid 60, so that it becomes possible to remove the ink pack 30 from the cabinet unit 20 for which the opening 24*a* is sealed by the sealing member 50, the welded part with the opening edge 24 of the sealing member 50 is peeled. The welded part can also be peeled from the opening edge 24 so as to completely separate the sealing member 50 and the cabinet unit 20.

Figure 18:
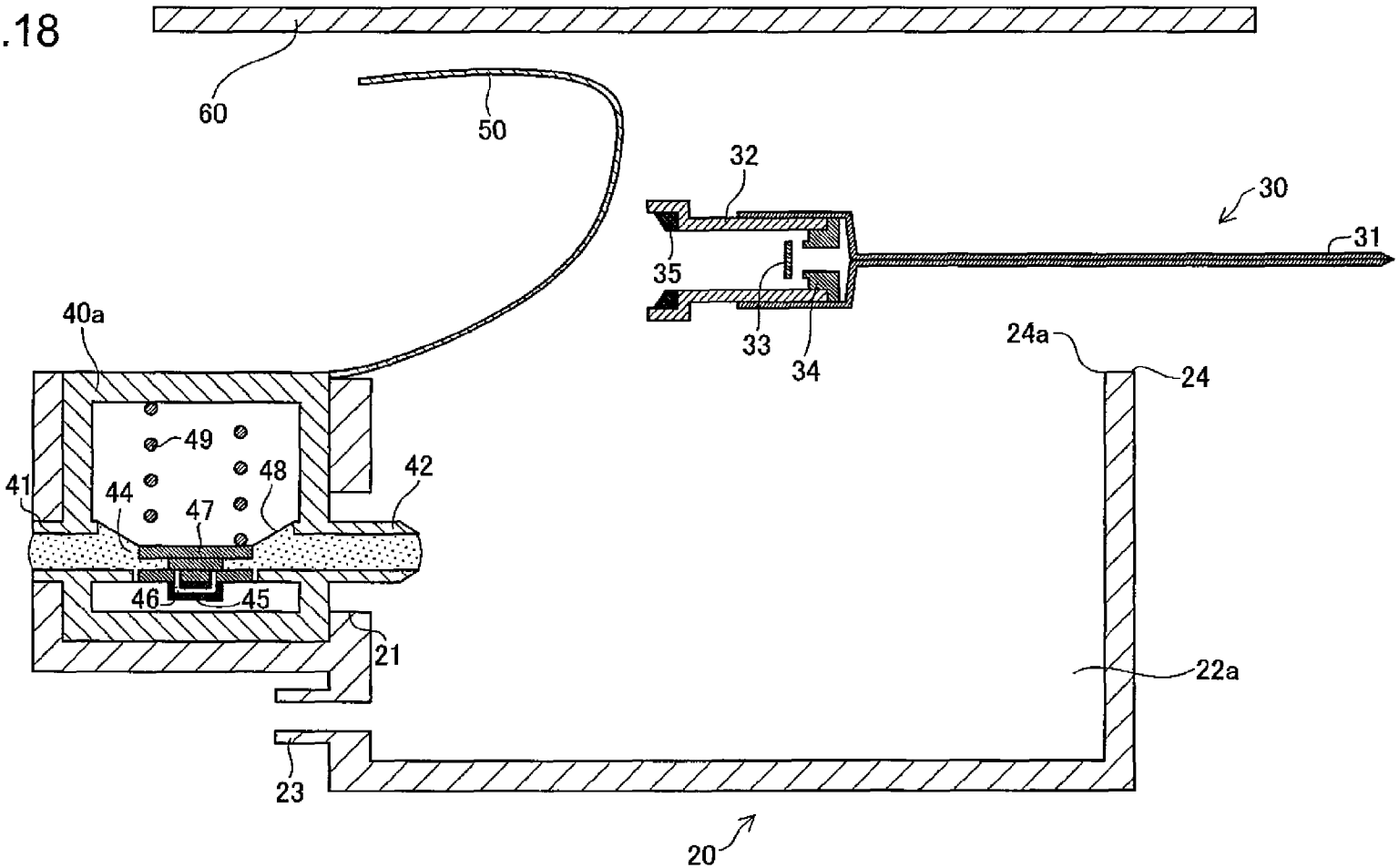
FIG. 18 is an explanatory drawing showing the state with the ink pack removed from the ink cartridge.

After the sealing member 50 is peeled off, the ink pack 30 is removed from the ink cartridge 10 (step S33). FIG. 18 is an explanatory drawing showing the state with the ink pack removed from the ink cartridge. As shown in FIG. 18, the removal of the ink pack 30 can be implemented by releasing the connection of the discharge unit 32 of the ink pack 30 and the introduction port 42, and by removing it to the outside of the cabinet unit 20 from the opening 24*a*.

Figure 19A:
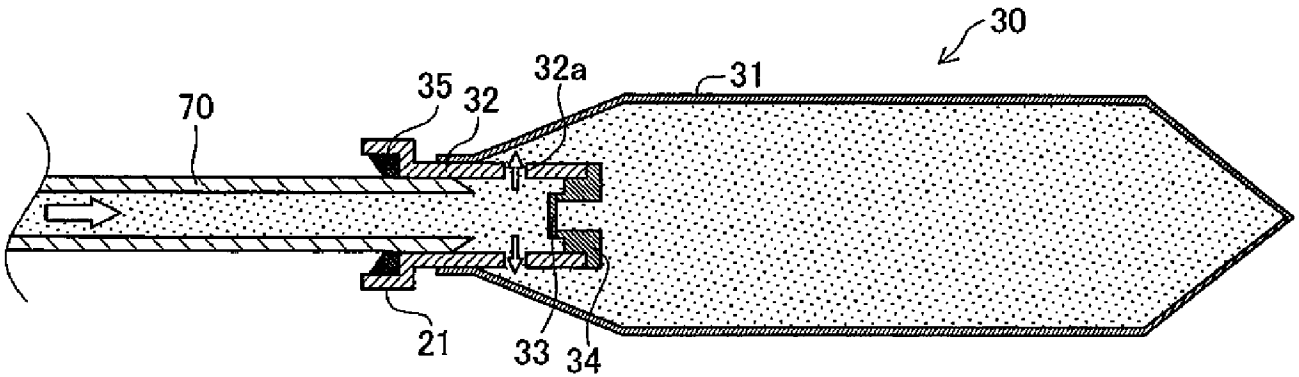
FIG. 19(A) and FIG. 19(B) are explanatory drawings showing the state with ink filled in the ink pack.
Figure 19B:
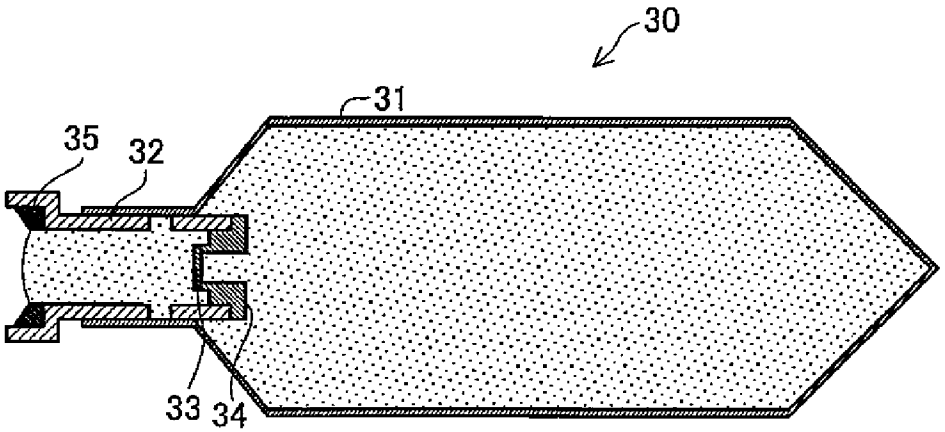

Filling of ink to the removed ink pack 30 is performed (step S34). FIG. 19 is an explanatory drawing showing the state with ink filled in the ink pack. When filling the ink, because the return check valve 33 functions, though it takes time, the pressure received by the return check valve 33 changes by changing of the injection flow volume of the charging difference, and it is also possible to fill by applying vibration. It is also possible to use the ink pack 30 filled with ink by the method shown in FIG. 19 without using the removed ink pack 30. As shown in FIG. 19(A), a supply port 70 of a filling device to which ink can be supplied and the ink pack 30 discharge unit 32 are connected, and the ink is flowed into the bag 31. The ink is flowed into the bag 31 via a bypass path 32*a* on the discharge unit 32, so it is possible to fill ink without blocking of the inflow by the return check valve 33. After the ink is filled, as shown in FIG. 19(B), the bypass path 32*a* is plugged by heat bonding of the bag 31. In addition to this, it goes without saying that in a case when the ink pack that is interchanged with the removed ink pack 30 is not equipped with a return check valve, or with an ink pack equipped with a return check valve that functions by being attached to the ink cartridge, when using an ink pack that is not a newly manufactured item, it is possible to do filling easily.

Figure 20:
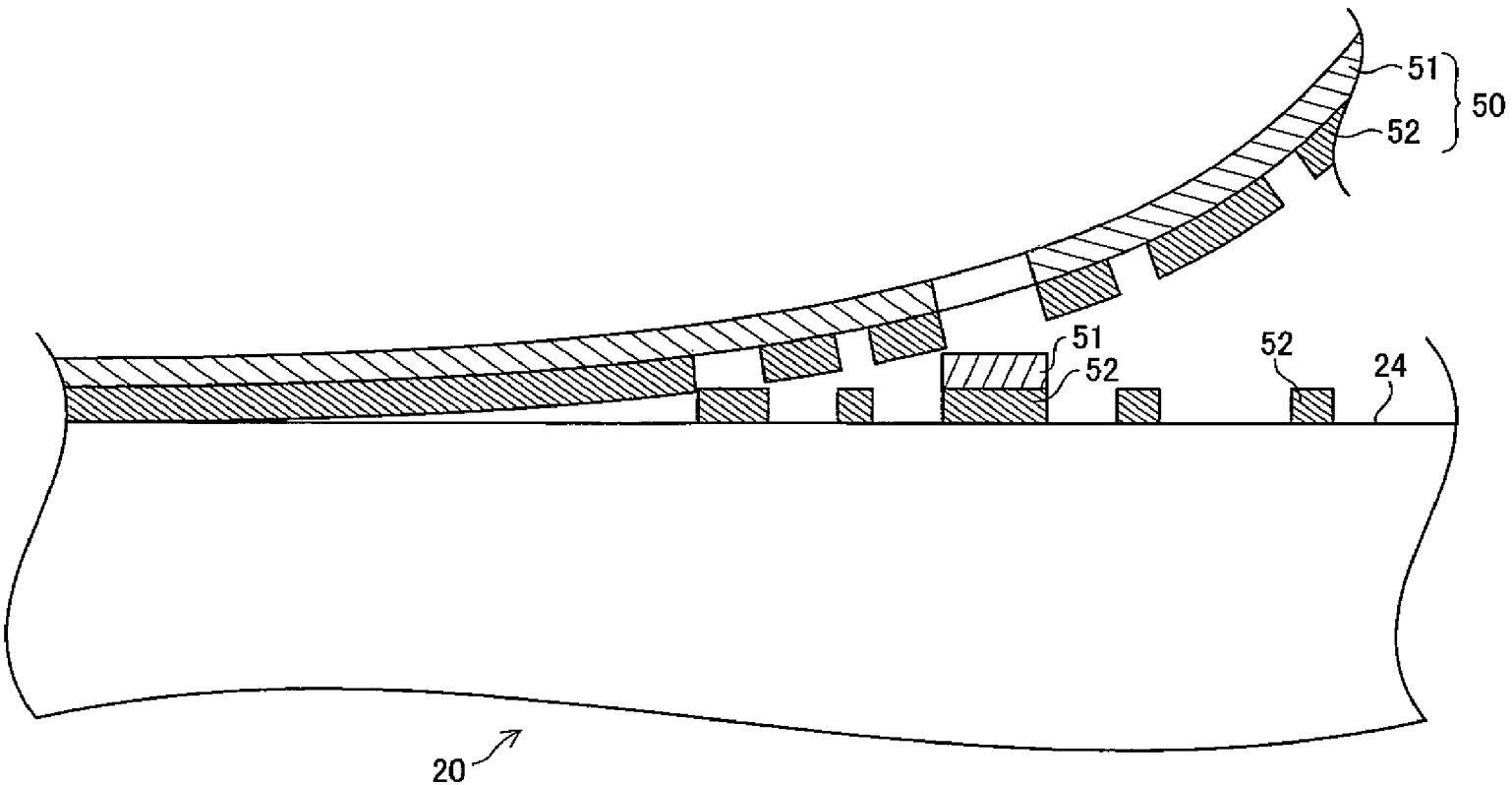
FIG. 20 is an explanatory drawing showing the state of the junction surface of the sealing member and the opening edge.

The opening edge 24 of the cabinet unit 20 is made smooth (step S35). FIG. 20 is an explanatory drawing showing the state of the junction surface of the sealing member and the opening edge. As shown in FIG. 20, when peeling the sealing member 50 from the opening edge 24, part of the junction material 52 is separated from the surface material 51, and is attached to the opening edge 24. Part of the surface material 51 is also separated and attached to the opening edge 24. Because of this, using a machining mechanism such as a grinder or the like, the surface of the opening edge 24 is scraped, and the surface material 51 and junction material 52 attached to the opening edge 24 are removed.

With this embodiment, the smoothing of the opening edge 24 is implemented after removing the ink pack 30 from the cabinet unit 20, but as long as it is after the sealing member 50 is peeled from the ink cartridge 10, it can also be implemented before removing the ink pack 30 from the ink cartridge 10. It is also possible to implement this after storing the ink pack 30 described later in the cabinet unit 20.

Figure 21:
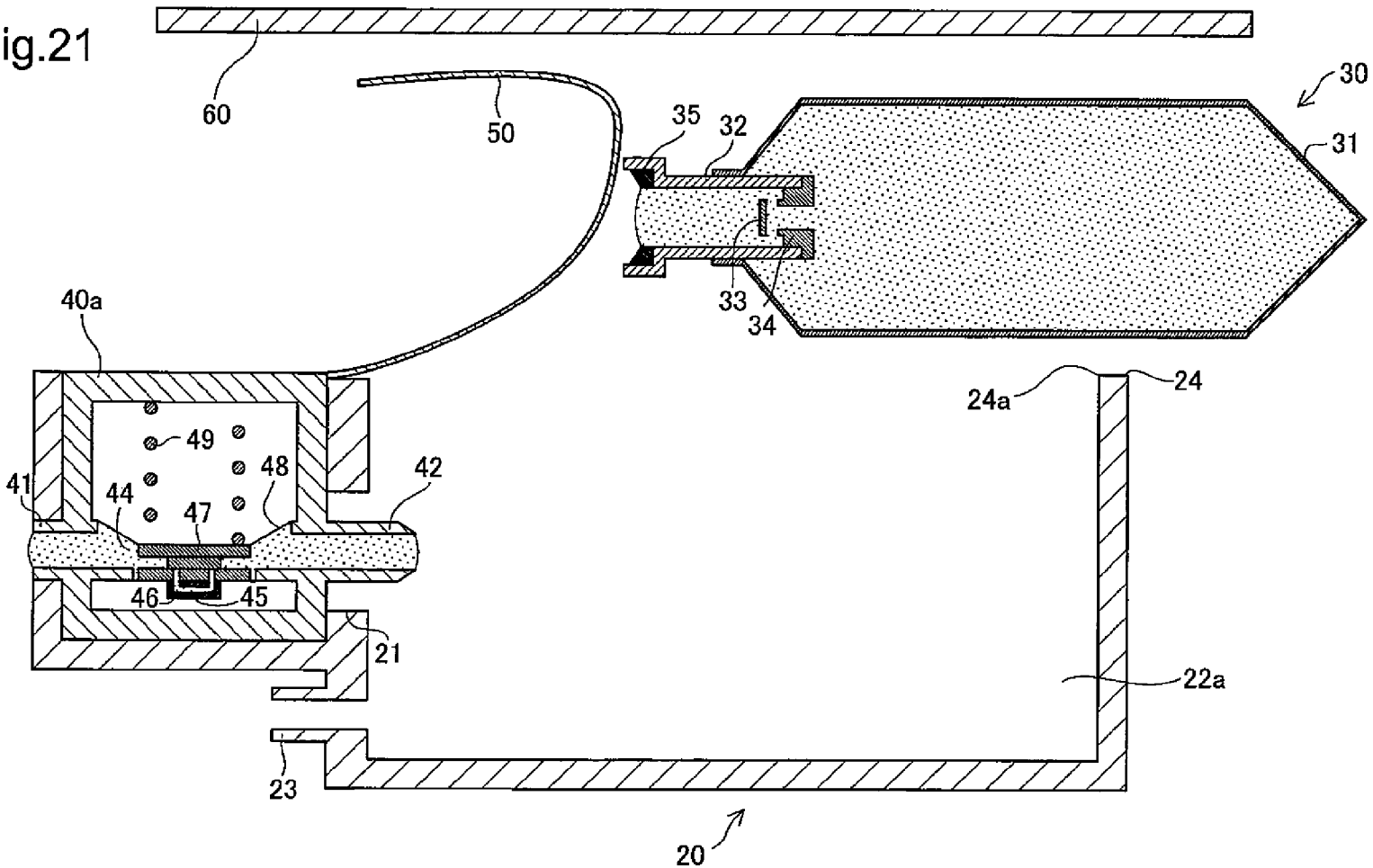
FIG. 21 is an explanatory drawing showing the state with the ink pack stored in the ink cartridge.

After the opening edge 24 is smoothed, the ink pack 30 is stored in the ink cartridge 10 (step S36). FIG. 21 is an explanatory drawing showing the state with the ink pack stored in the ink cartridge. As shown in FIG. 21, the ink pack 30 filled with ink is arranged inside the cabinet unit 20 from the opening 24*a*, and this is stored in the ink cartridge 10 by the discharge 32 being connected with the introduction port 42.

Figure 22A:
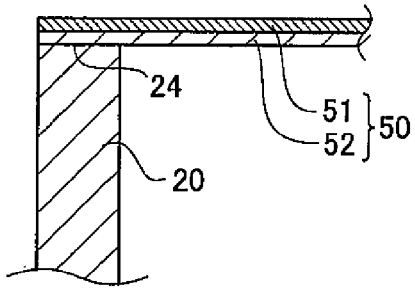
FIG. 22(A) through FIG. 22(C) are explanatory drawings showing the state of the contact part of the sealing member and the opening edge.

The sealing member 50 is welded to the ink cartridge 10 in which the ink pack 30 is stored (step S37). FIG. 22 is an explanatory drawing showing the state of the contact part of the sealing member and the opening edge. As shown in FIG. 22(A), with this embodiment, the junction material 52 that the sealing member 50 is equipped with and the opening edge 24 are in contact, and this is welded to the opening edge 24 by fusing the junction material 52 using heat. By doing this, the sealing member 50 seals the opening 24*a*.

Figure 22B:
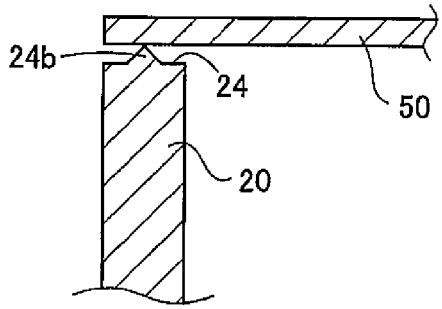
Figure 22C:
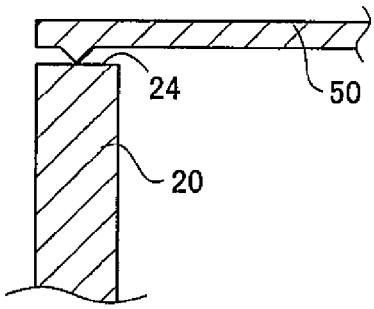

In addition to the heat bonding of this embodiment for the welding of the sealing member 50 and the opening edge 24, it is also possible to repeatedly add compression force to the sealing member 50, to do ultrasonic welding that adheres by heat generation inside the member, or to use vibration bonding that adheres by heat using friction. In this case, as shown in FIG. 22(B), a convex part 24*b* is formed on the opening edge 24, and welding can be done by fusing the convex part 24*b* using heat. Also, as shown in FIG. 22(C), it is also possible for the sealing member 50 to be equipped with a convex part. By welding of the sealing member 50, regeneration of the ink cartridge of the third embodiment is completed.

With the ink cartridge manufacturing method of the third embodiment described above, even when filling ink in the used ink cartridge 10, the ink pack 30 is removed from the opening 24*a*, so it is possible to fill ink in the ink pack 30 without using the flow path inside the liquid volume detector device. Also, to store the ink pack 30 filled with ink in the ink cartridge 10, while reducing the possibility of problems occurring in the liquid volume detector device due to filling, it is possible to easily fill the ink cartridge 10 with ink. Note that the ink cartridge manufacturing method of the embodiment noted above can also be called an ink cartridge regenerating method.

With the ink cartridge manufacturing method of the third embodiment, the surface of the opening edge 24 is machined before welding the sealing member 50 to the cabinet unit 20, so it is possible to remove the junction material 52 and the like adhered to the opening edge 24, and it is possible to easily weld the sealing member 50.

With the ink cartridge manufacturing method of the third embodiment, storing in the cabinet unit 20 is done after filling of the ink in the ink pack 30, so, for example, with a new ink pack, it is possible to fill the ink using a method called a bypass path that does not go via the return check valve, and it is possible to easily fill ink in the ink cartridge 10.

With the ink cartridge manufacturing method of the third embodiment, the sealing member 50 and the opening edge 24 are welded using heat bonding, ultrasonic welding, or vibration bonding. By doing this, because the inside of the ink receiving chamber 22*a* is airtight sealed, it is possible for the ink cartridge 10 to supply ink with stability.

With the ink cartridge manufacturing method of the third embodiment, the ink cartridge 10 is equipped with a liquid volume detector device 40, so it is possible to fill ink even in the ink cartridge 10 equipped with the liquid volume detector device 40.

Example of Use of the Ink Cartridge of this Embodiment

An example of using the ink cartridge 10 manufactured by the ink cartridge manufacturing method of this embodiment will now be described. FIG. 11 is an explanatory drawing showing the schematic structure of the printer using the ink cartridge. The printer 100 is an inkjet printer for recording text or graphics by spraying ink drops on the printing paper P. The printer 100 is equipped with the paper supply tray 15, the paper ejection tray 16, and the case 17. The printer 100 introduces the printing paper P from the paper supply tray 15 to inside the case 17, sprays ink drops with the printing mechanism 13 inside the case 17, and discharges the printing paper P on which text or graphics are recorded from the paper ejection tray 16 to outside the case 17.

The case 17 is constituted from the lid and the main body, and inside it are stored the ink cartridge 10 of this embodiment, the ink supply unit 11, the supply tube 12, the printing mechanism 13, and the control unit 14.

The ink cartridge 10 receives ink of different colors for each ink cartridge inside it. With this embodiment, each ink cartridge 10 receiving black, cyan, magenta, and yellow ink is connected to the ink supply unit 11. As another embodiment, with a printer that performs printing with four or more colors of ink, it is also possible to connect four or more colors of ink cartridges 10 to the ink supply unit 11.

The ink supply unit 11 has the ink cartridge 10 and the supply tube 12 connected. The supply of ink is received from the connected ink cartridge 10, and ink is supplied via the supply tube 12 to the printing mechanism 13. The supply tube 12 is formed with a material having gas permeability, for example, a thermoplastic elastomer such as an olefin, a styrene or the like.

The printing mechanism 13 incorporates a spray head (not illustrated), and is equipped with a carriage (not illustrated) connected to the supply tube 12. The carriage is moved by a motor (not illustrated), and spraying of ink drops on the printing paper P is performed from the spray head.

The control unit 14 controls each part of the printer 100. The control unit 14 an includes ASIC (Application Specific Integrated Circuit) equipped with hardware such as a central processing unit (CPU) (not shown), a read only memory (ROM), and random access memory (RAM) and the like. Software for realizing the various functions of the printer 100 is installed in the control unit 14. It is also electrically connected with the integrated circuit substrate 43 and receives information regarding the remaining volume of ink.

Modified Embodiments

It is to be understood that the present invention can be embodied in various modes other modes without departing from the scope and spirit thereof.

Modified Embodiment 1

Figure 23:
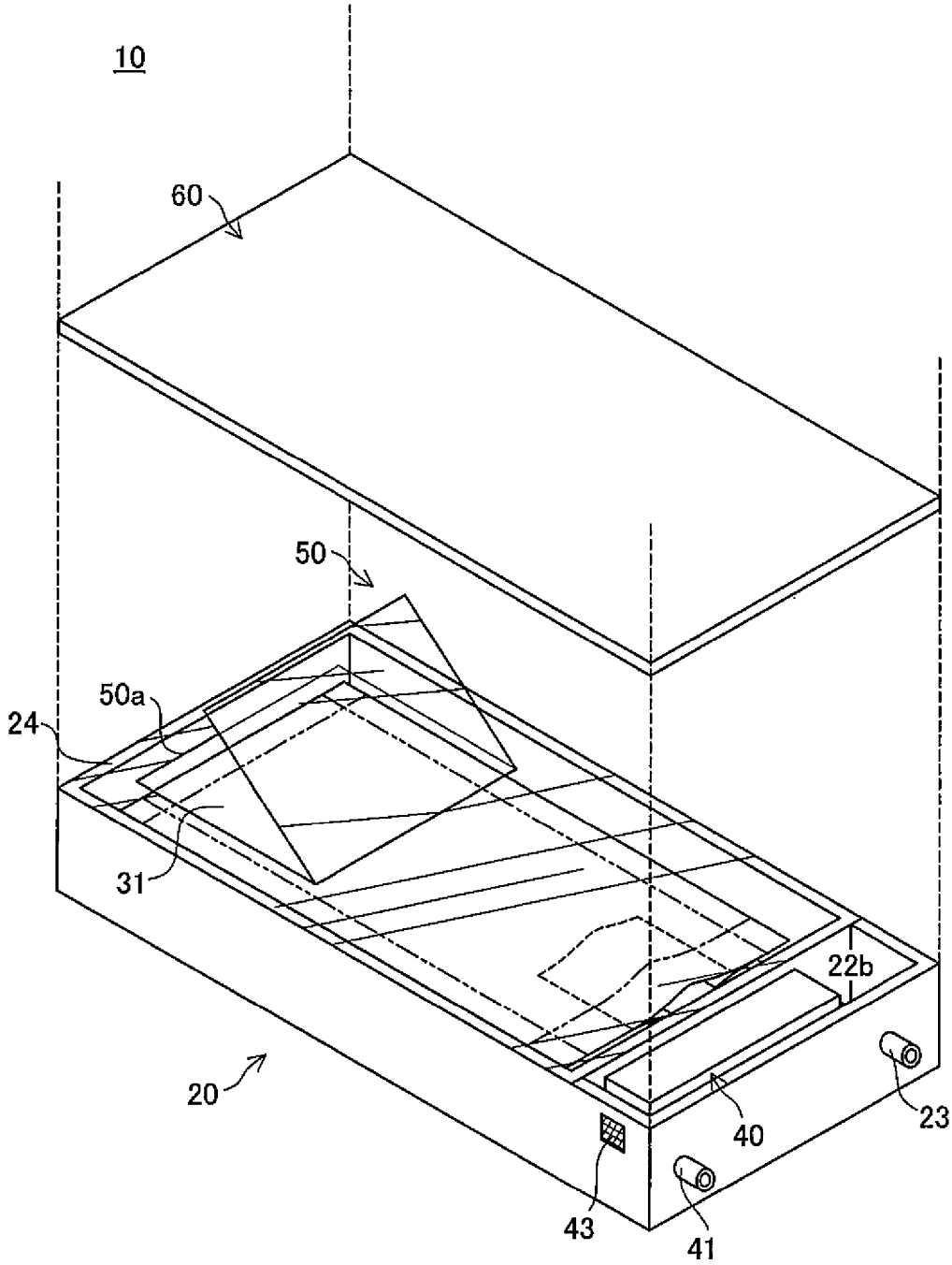
FIG. 23 is an explanatory drawing of removing the ink pack from the ink cartridge with variation example 1.

FIG. 23 is an explanatory drawing of removing the ink pack from the ink cartridge with variation example 1. With this embodiment the sealing member 50 is separated from the opening edge 24 and the ink pack 30 is removed from the opening 24*a*, but it is also possible to provide a sealing member opening 50*a* at part of the sealing member 50 to remove the ink pack 30.

Modified Embodiment 2

Figure 24:
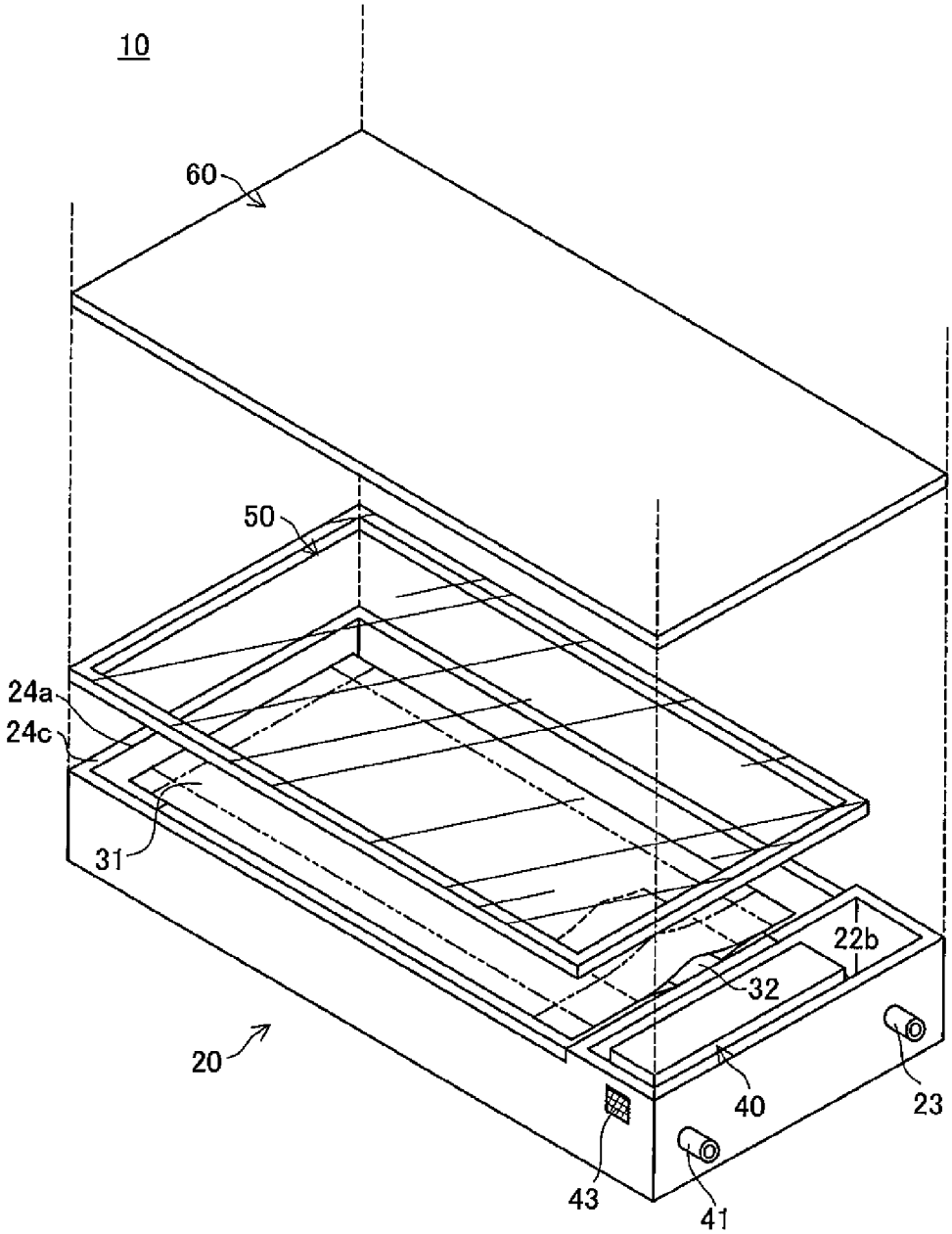
FIG. 24 is an explanatory drawing of removing the ink pack from the ink cartridge with variation example 2.

FIG. 24 is an explanatory drawing of removing the ink pack from the ink cartridge with variation example 2. With this embodiment, the sealing member 50 is separated from the opening edge 24 and the ink pack 30 is removed from the opening 24*a*, but it is also possible to remove the ink pack 30 by cutting the cabinet unit 20 near the opening edge 24. In this case, for the sealing of the opening 24*a*, the sealing member 50 is welded to the generated surface 24*c* newly created by cutting.

Modified Embodiment 3

The ink cartridge 10 of this embodiment has adhesion of the sealing member 50 and the opening edge 24 implemented by welding, but as long as the opening 24*a* is airtight sealed, adhesion can be done using an adhesive agent or the like.

Fourth Embodiment

With the fourth embodiment, we will describe the method of filling liquid to the liquid container.

Figure 25:
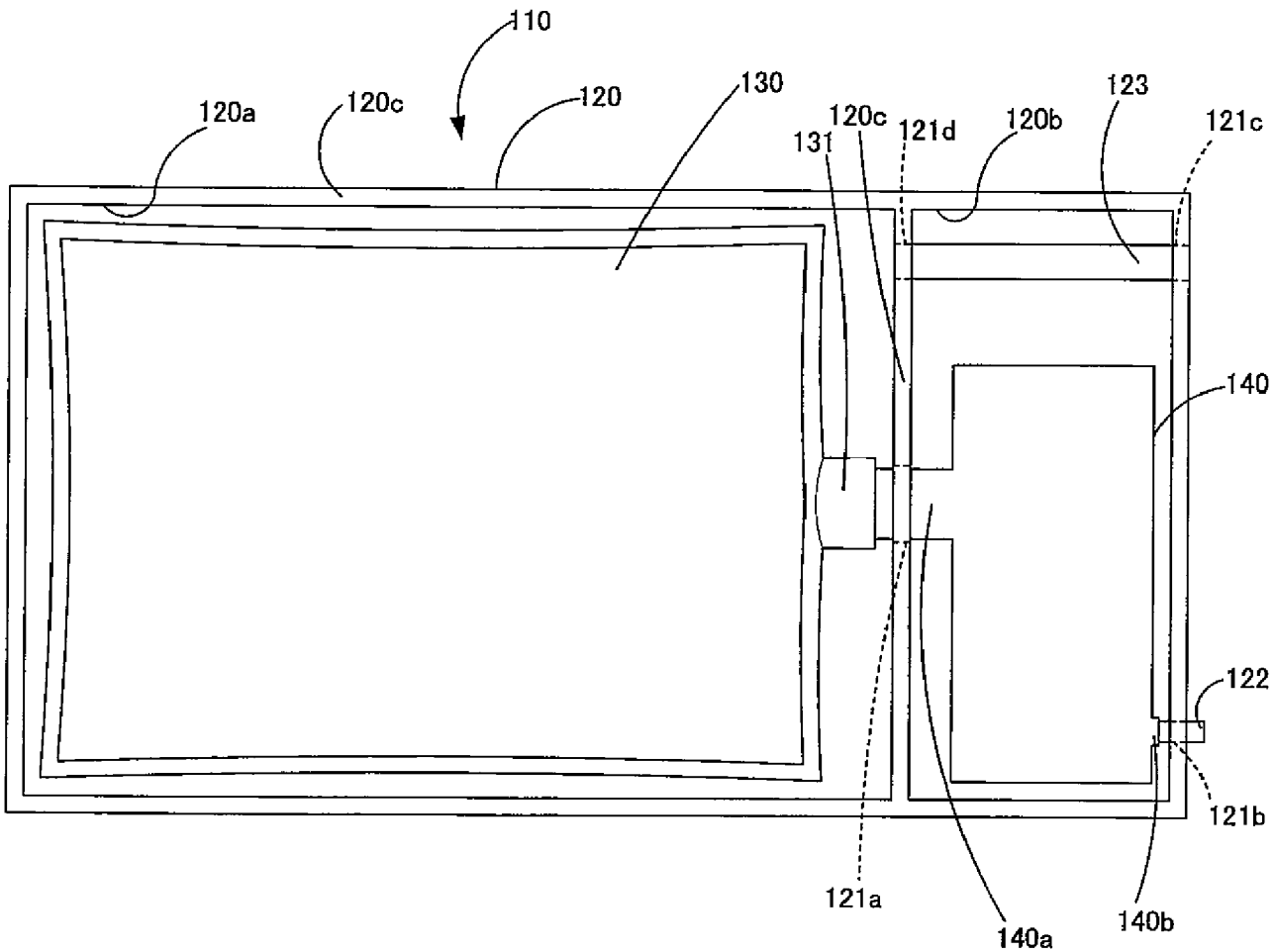
FIG. 25 is a plan view typically showing the liquid container used with the fourth embodiment.
Figure 26:
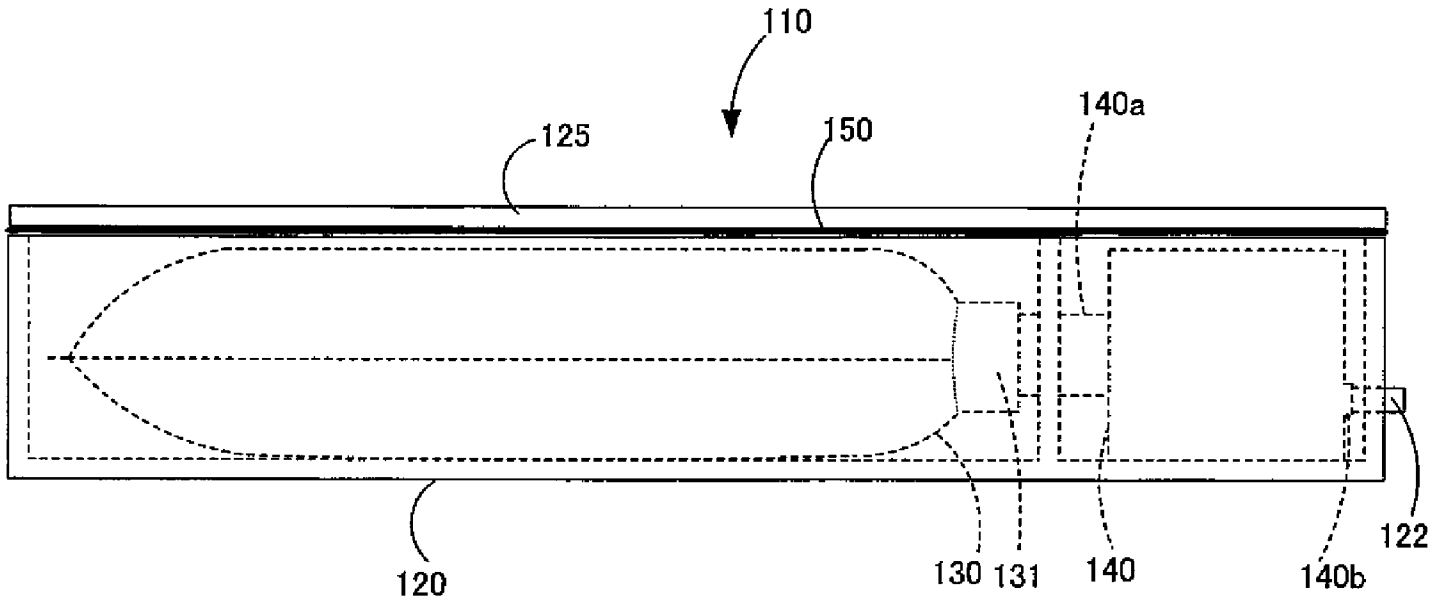
FIG. 26 is a side view typically showing the liquid container used with the fourth embodiment.
Figure 27:
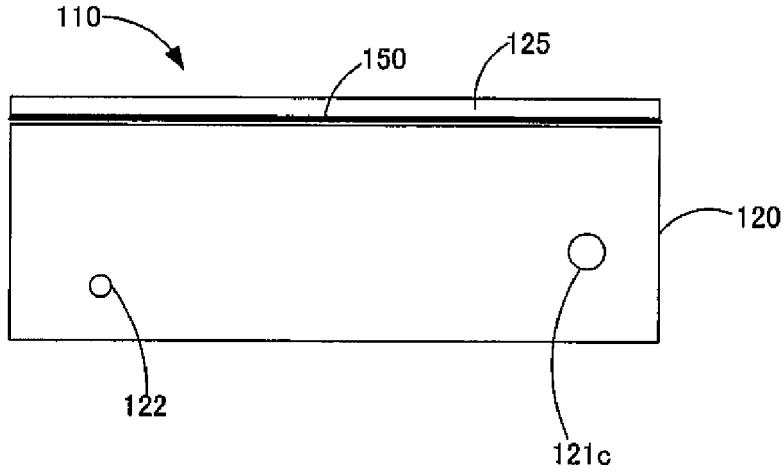
FIG. 27 is a front view typically showing the liquid container used with the fourth embodiment.
Figure 28:
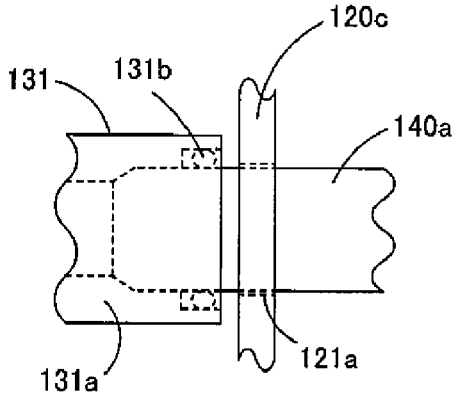
FIG. 28 is an explanatory drawing showing the junction of the liquid receptacle and the liquid volume detector used with the fourth embodiment.

FIG. 25 is a plan view typically showing the liquid container used with this embodiment. FIG. 26 is a side view typically showing the liquid container used with this embodiment. FIG. 27 is a front view typically showing the liquid container used with this embodiment. FIG. 28 is an explanatory drawing showing the junction of the liquid receptacle and the liquid volume detector used with this embodiment.

With this embodiment, as an example of the liquid container, an ink cartridge used mounted on an inkjet printer is used. The ink cartridge 110 of this embodiment is equipped with the case 120, the lid 125, the ink receptor 130, and the ink volume sensor 140. Note that with FIG. 25, for purposes of explanation, this will described using the ink cartridge 110 which is not equipped with the lid 125. Also, the ink receptor 130 correlates to the liquid receptacle and the ink volume sensor 140 correlates to the liquid volume detector.

The case 120 has an external appearance forming a roughly rectangular solid shape and has two independent items, an ink receiving chamber 120*a* and sensor receiving chamber 120*b*. Each receiving chamber 120*a* and 120*b* has segments formed by a wall surface 120*c*, and the top surface is open. The case 120 is formed, for example, by a resin material including a thermoplastic resin, a metal material, or a hybrid material of metal and resin.

The case 120 is equipped with the first opening 121*a*, the second opening 121*b*, the third opening 121*c*, and the fourth opening 121*d*. The first opening 121*a* and the fourth opening 121*d* link the ink receiving chamber 120*a* and the sensor receiving chamber 120*b*, and the second opening 121*b* and the third opening 121*c* link the sensor receiving chamber 120*b* and the case exterior.

The first opening 121*a* is used to connect the ink receptor 130 and the ink volume sensor 140. The second opening 121*b* is used to arrange the ink supply port 122. The third opening 121*c* and the fourth opening 121*d* are used to arrange the pressurization tube 123 for supplying pressurized air to the ink receiving chamber 120*a* from the case exterior.

The lid 125 has a shape corresponding to the top surface shape of the case 120. As shown in FIG. 26 and FIG. 27, each opening of the case 120 is airtight sealed by the sealing material 150, and the lid 125 is mounted on the case 120 overlapping the sealing material 150. The sealing material 150 seals the openings of each receiving chamber 120*a* and 120*b* to airtight seal at least the ink receiving chamber 120*a*. When the ink cartridge 110 is mounted in the printing device, pressurized air is supplied to the ink receiving chamber 120*a* via the pressurization tube 123 from the printing device. This pressurization process is executed to smooth the supply of ink to the printing device by adding pressure from the outside to the ink receptor 130. Therefore, the ink receiving chamber 120*a* is required to be airtight sealed. As the sealing material 150, it would be possible to use for example a laminate film composed of the same material as the case 120, e.g. polyethylene terephthalate with a polystyrene backing. The sealing material 150 is adhered in a state with the surface of the same material as the case 120 used as the wall surface side of the case 120.

The ink receptor 130 is equipped with a bag shaped main body and the ink lead-out unit 131 mounted at one edge of the main body. The main body is formed from a multi layer film of a rectangular shape for which a gas barrier layer is formed by lamination on the resin film layer, for example. The ink lead-out unit 131 is formed by a round cylinder shaped resin member that can be heat bonded with the resin film layer. The ink receptor 130 is formed by sandwiching the ink lead-out unit 131 between one side of two multi layer films that are overlapped, and with this embodiment, one side among the short sides, and by heat bonding the film edge part and the film and the ink lead-out unit 131. As the resin film layer, for example, a thermoplastic resin that can be heat bonded, such as polyethylene or propylene can be used, as the gas barrier layer, aluminum can be used, and as the backing member, polyamide or polyethylene terephthalate can be used.

The ink volume sensor 140 is equipped with a sensor module unit described later, a first connecting unit 140*a*, and a second connecting unit 140*b*. The first connecting unit 140*a* is mounted on the ink lead-out unit 131 of the ink receptor 130 via the first opening 121*a*. In specific terms, as shown in FIG. 28, the tip of the first connecting unit is inserted through the first connecting unit 140*a* until it reaches the receiving part inside the ink lead-out unit 131. The outer periphery surface of the first connecting unit 140*a* and the inner periphery surface of the ink lead-out unit 131 are sealed by the sealing member.

The ink supply port 122 is mounted on the second connecting unit 140*b* via the second opening 121*b*. Note that the ink supply port 122 can be formed as an integrated unit with the second connecting unit 140*b*. In this case, the second connecting unit 140*b* that functions as the ink supply port projects from the second opening 121*b*.

Figure 29:
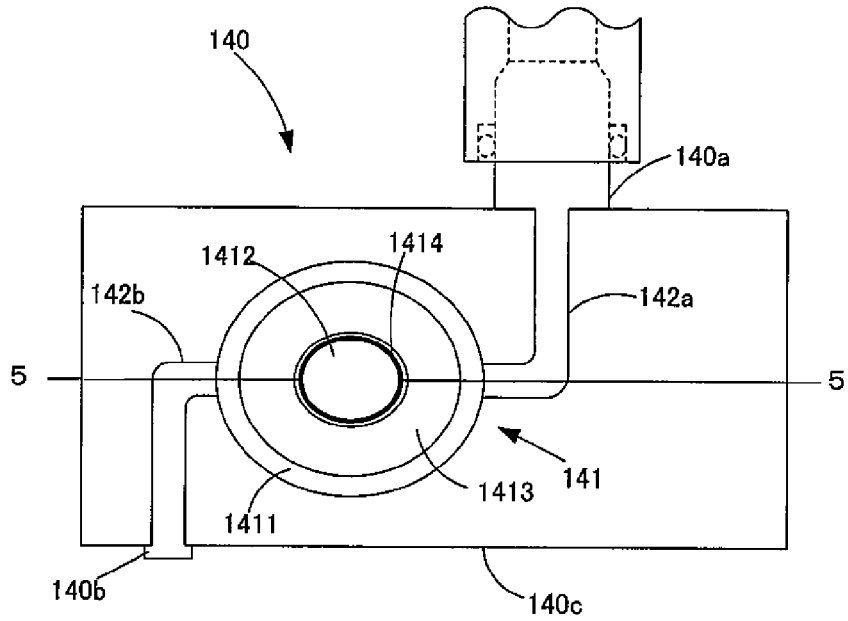
FIG. 29 is a plan view typically showing the sensor module of the ink volume sensor of the fourth embodiment.
Figure 30:
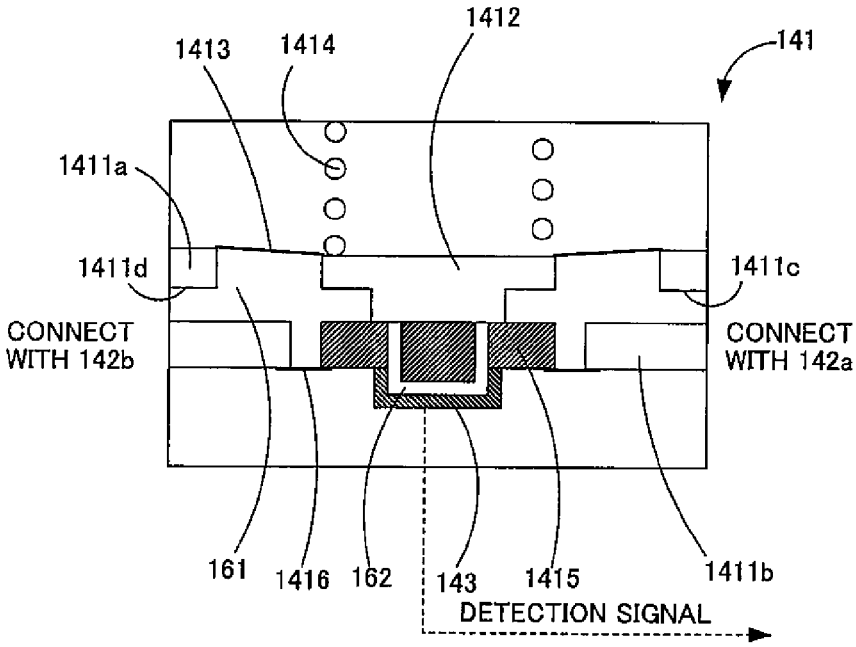
FIG. 30 is an explanatory drawing typically showing the cross section of the sensor module cut at line 5-5 of FIG. 29.

Ink Volume Sensor Constitution:

FIG. 29 is a plan view typically showing the sensor module of the ink volume sensor of this embodiment. FIG. 30 is an explanatory drawing typically showing the cross section of the sensor module cut at line 5-5 of FIG. 29.

The ink volume sensor 140 is equipped with the first connecting unit 140*a* and the second connecting unit 140*b* on the case 40C as described previously. Note that for purposes of explanation, FIG. 29 shows the state with the top surface of the case 40C of the ink volume sensor 140 removed.

The ink volume sensor 140 is equipped with the sensor module 141, a first linking path 142*a*, and a second linking path 142*b*. The first linking path 142*a* links the sensor module 141 and the first connecting unit 140*a*, and the second linking path 142*b* links the sensor module 141 and the second connecting unit 140*b*.

The sensor module 141 is equipped with a sensor case 1411, a pressure receiving body 1412, a diaphragm 1413, a biasing member 1414, a detection flow path forming member 1415, and a sensor 143. The sensor case 1411 planar view makes a circular ring shape, and is equipped with a top side case member 1411*a* and a bottom side case member 1411*b* for which the circular ring widths differ. With this embodiment, the circular ring width of the bottom side case member 1411*b* is larger than the circular ring width of the top side case member 1411*a*. As shown in FIG. 30, at the connecting part of the first linking path 142*a* and the second linking path 142*b* of the sensor case 1411, the linking unit 1411*c* and 1411*d* for linking the outside of the sensor case 1411 and the inside of the sensor case 1411 are respectively formed.

The detection flow path forming member 1415 has two flow paths inside, and is fixed to the bottom side case member 1411*b* by the circular ring fixing member 1416. A detection flow path 162 is formed by the two flow paths of the detection flow path forming member 1415 and the ⊐shaped sensor 143. The sensor 143 can be constituted from a vibrating plate that directly contacts the fluid and the sensor main body, or it can be constituted from only the sensor main body. As the sensor main body, an electrostriction component which is a passive component that is deformed (electrostriction) by the application of voltage and that outputs voltage (back electromotive force) according to outside force is used. As the electrostriction component (piezoelectric element), for example, it is possible to use zircon lead titanate (PZT), lead lanthanum zirconate titanate (PZTL), or a lead-free piezoelectric film that does not use lead. The detection signals generated by the sensor 143 are sent to a control circuit (not illustrated).

The pressure receiving body 1412 is equipped with a bottom side part having a size that can close the detection flow path 162, and a top side part of a size that can be in contact with the biasing member 1414. The pressure receiving body 1412 is connected to the top side case member 1411*a* by the diaphragm 1413.

An ink flow path 161 is formed on the sensor case 1411. When the pressure receiving body 1412 is in contact with the detection flow path forming member 1415 by the biasing force of the biasing member 1414, the ink flows through the ink flow path 161. Meanwhile, when the pressure receiving body 1412 and the detection flow path forming member 1415 are divided, the ink flows through the two flow paths of the ink flow path 161 and the detection flow path 162.

The biasing force applied to the pressure receiving body 1412 by the biasing member 1414 can be set, for example, to be weaker than the pressurization force applied to the ink receptor 130 by the pressurized air during use. As a result, during use, the pressure receiving body 1412 and the detection flow path forming member 1415 are divided, and when not used (when removed, when non-pressurized), the pressure receiving body 1412 and the detection flow path forming member 1415 are in contact, and mixing or the like of air bubbles in the detection flow path 162 is suppressed and prevented.

We will give a brief description of the ink volume detection using the sensor module 141. The sensor 143 has the role of both an exciter that gives excitation oscillation to an oscillation system, and an oscillation detector that detects the oscillation frequency for an oscillation system. In specific terms, the sensor 143 starts excitation oscillation by stopping the application of drive signals after electrostriction by application of square wave drive signals. By matching the excitation oscillation count given to the oscillation system by the sensor 143, specifically, the frequency of the drive signals applied to the sensor 143, to the oscillation count inherent to the oscillation system of the sensor module 141, resonance occurs in the oscillation system. The sensor 143 varies according to the generated resonant oscillation, specifically, the oscillation is detected, and the voltage value that varies according to the detected oscillation, specifically, the resonance frequency signals, are output as the detection result signals.

The oscillation system of the sensor module 141 indicates a different inherent oscillation count according to whether or not the detection flow path 162 is plugged by the pressure receiving body 1412. Pressurization force acts on the ink receptor 130, and when there is a larger amount of ink than the specified volume in the ink receptor 130, the pressure receiving body 1412 and the detection flow path forming member 1415 are divided by high ink pressure, and when there is a smaller amount of ink than the specified volume in the ink receptor 130, the pressure receiving body 1412 and the detection flow path forming member 1415 are in contact by the drop in ink pressure. Therefore, the detection flow path 162 is linked with the ink flow path 161 when there is a larger volume of ink than the specified volume in the ink receptor 130, and is separated from the ink flow path 161 when there is ink of the specified volume or less in the ink receptor 130. Specifically, by using the difference in the back electromotive force brought by the difference in the inherent oscillation count for the oscillation system formed when the detection flow path 162 is plugged by the pressure receiving body 1412 and for the oscillation system formed when not plugged, it is possible to judge whether or not the ink volume received in the ink receptor 130 is the specified volume or less. Note that the ink volume sensor 140 performs detection of the ink volume based on changes in ink pressure, so it can be called a pressure sensor.

The ink volume sensor 140 of this embodiment is a sensor that judges whether or not the ink volume in the ink receptor 130 is a specified volume or greater as described above (whether it is less than a specified volume), but in addition to this, for example, it goes without saying that it is also possible to use a sensor that can detect the consumed volume or the remaining volume by detecting the total volume (flow volume) of ink supplied to the printer.

Figure 31:
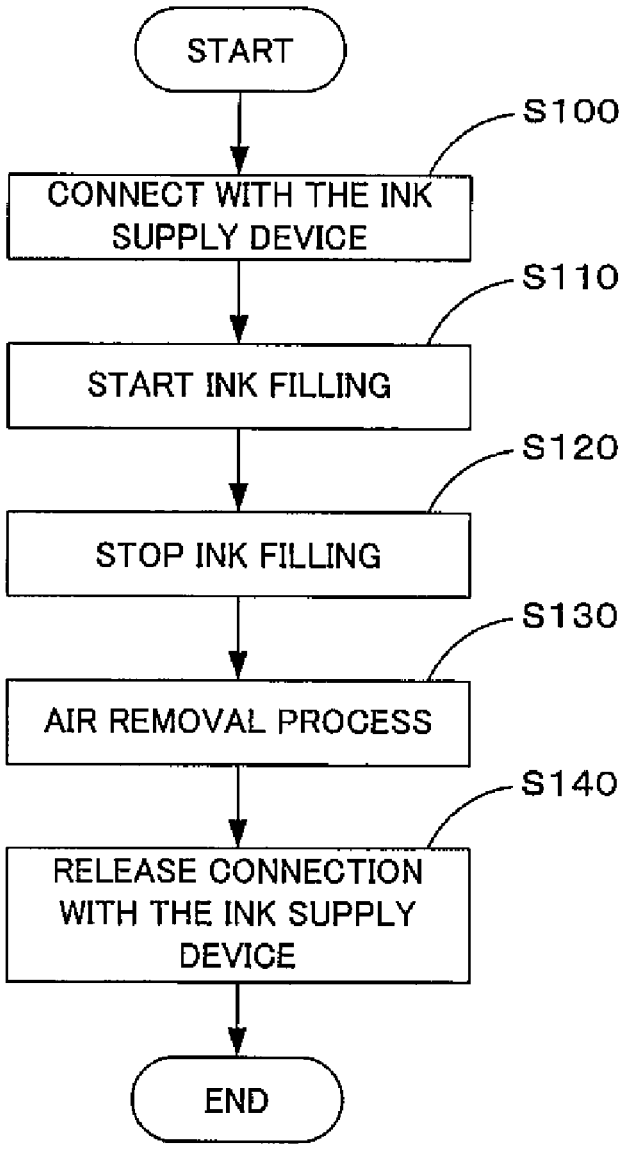
FIG. 31 is a flow chart showing the ink filling process of the fourth embodiment.
Figure 32:
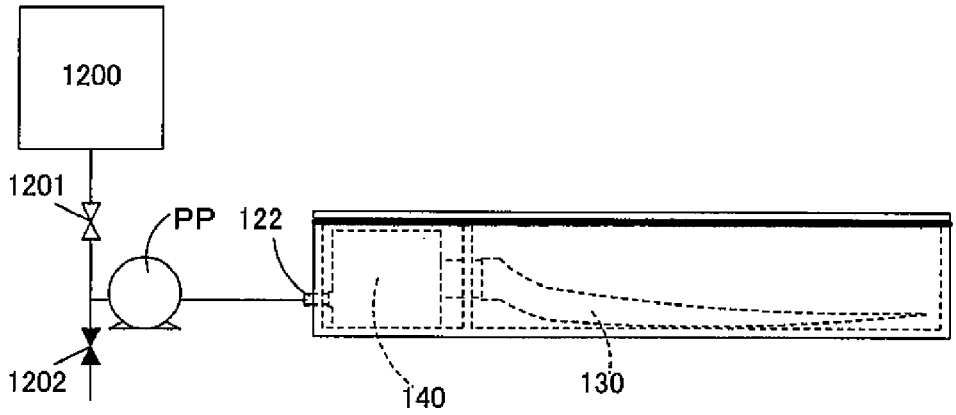
FIG. 32 is an explanatory drawing showing the state of the ink cartridge at the start of the ink filling process.
Figure 33:
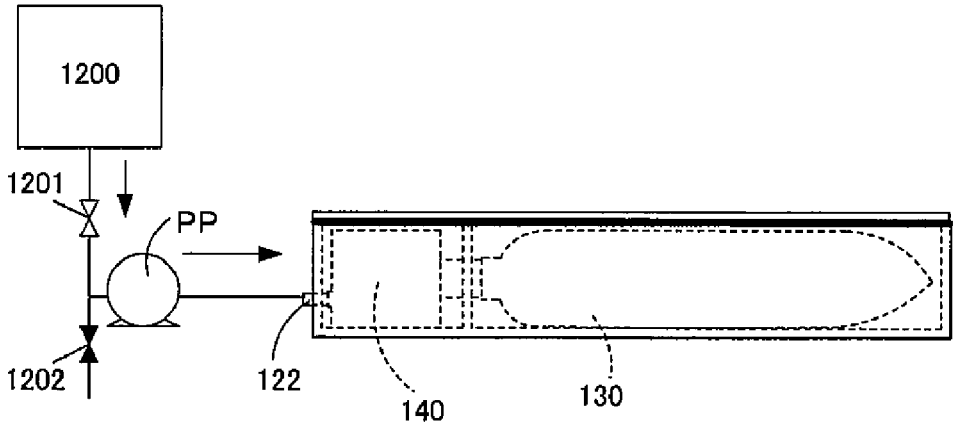
FIG. 33 is an explanatory drawing showing the state of the ink cartridge midway in the ink filling process.
Figure 34:
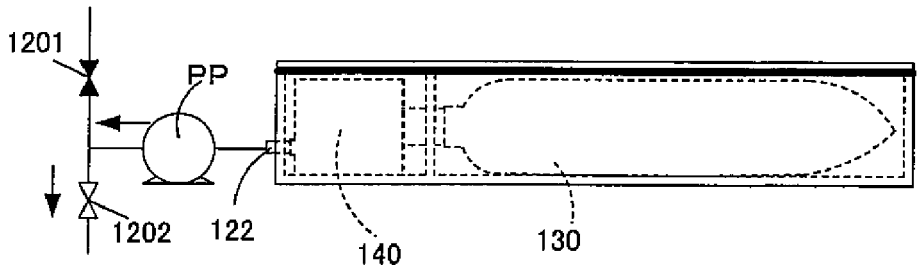
FIG. 34 is an explanatory drawing showing the state of the ink cartridge at the end of the ink filling process.

The method of filling ink in the ink cartridge 110 of this embodiment will now be described. FIG. 31 is a flow chart showing the ink filling process of this embodiment. FIG. 32 is an explanatory drawing showing the state of the ink cartridge at the start of the ink filling process. FIG. 33 is an explanatory drawing showing the state of the ink cartridge midway in the ink filling process. FIG. 34 is an explanatory drawing showing the state of the ink cartridge at the end of the ink filling process.

The ink supply device used with the following process is equipped with an ink reservoir tank 1200, a first control valve 1201, a second control valve 1202, and an ink supply pump PP. During ink supply, the first control valve 1201 is in a linked state (open), and the second control valve 1202 is in an unlinked state (closed), and during the air removal process, the first control valve 1201 is in an unlinked state (closed), and the second control valve 1202 is in a linked state (open). Note that in FIG. 32 to 10, the open control valve is white, and the closed control valve is black.

The ink supply port 122 and the ink supply device for the ink cartridge 110 are connected (step S100: see FIG. 32). In specific terms, the ink supply port 122 of the ink cartridge 110 in a state with the ink receptor 130 and the ink volume sensor 140 incorporated is connected to the supply tube that is connected to the discharge port of the ink supply pump PP. The ink cartridge 110 can be a newly manufactured ink cartridge, or it can be an ink cartridge that was used once and is refilled with ink for reuse. In the case of a new ink cartridge, there is no ink in the internal flow paths of the ink receptor 130 and the ink volume sensor 140. On the other hand, in the case of a used ink cartridge, when cleaning has not been executed on the ink receptor 130 and the ink volume sensor 140, there is ink in the internal flow paths of the ink receptor 130 and the ink volume sensor 140.

The ink supply pump PP is operated with the first control valve 1201 in a linked state, and the second control valve 1202 in a non-linked state, and filling of ink to the ink receptor 130 via the ink volume sensor 140 starts (step S110: see FIG. 33). The ink supplied via the ink supply port 122 flows to the ink receptor 130 via the internal flow paths of the ink volume sensor 140, specifically, at least the first linking path 142*a*, the second linking path 142*b*, and the ink flow path 161.

Note that when a return check valve is equipped in the ink receptor 130 to prevent or suppress the reverse inflow of ink from the outside, for example when equipped in the ink lead-out unit 131, a contrivance is required for the filling of ink. For example, filling of ink is performed by supply pressure that is less than the operating pressure of the return check valve, an operating unit is provided on the ink receptor 130 for turning off the return check valve function from the outside, and during ink filling, the return check valve function is turned off. Alternatively, it is possible to have at least two flow paths formed on the ink lead-out unit 131 of the ink receptor 130 that link with the ink receptor 130, and to provide a switching valve for switching the two flow paths. A return check valve can be provided on one flow path, and during normal use, the flow path equipped with the return check valve is operated, and during ink filling, the other flow path that is not equipped with a return check valve is operated.

Meanwhile, when the return check valve is not equipped in the ink receptor 130, ink can be filled inside the ink receptor 130 simply by operating the ink supply pump PP.

When a specified volume of ink is filled in the ink receptor 130, the ink supply pump PP is stopped, and the filling of ink to the ink receptor 130 stops (step S120).

When the ink filling ends, the first control valve 1201 is in a non-linked state, and the second control valve 1202 is in a linked state, the ink supply pump PP is put to reverse operation, and the air removal process is executed (step S130: see FIG. 34). With this embodiment, the air removal process is not a required process, but by executing the air removal process together, it is possible to improve the reliability of eliminating mixing of air bubbles in the sensor module 141, particularly the detection flow path 162. In specific terms, the pressure receiving body 1412 with the sensor module 141 is divided from the detection flow path forming member 1415, and the suction process is executed by the pressure that brings the inflow of ink to the detection flow path 162. As a result, the air bubbles inside the detection flow path 162 are discharged to outside the ink cartridge 110. Also, at the same time, the air bubbles inside the ink volume sensor 140 and the ink receptor 130 are also discharged to outside the ink cartridge 110. As a result, it is possible to suppress or stop the generation of ink volume detection errors due to air bubble mixing.

When the air removal process is completed, the connection between the ink cartridge 110 ink supply port 122 and the ink supply device is released (step S104). Specifically, the supply tube is removed from the ink supply port 122.

Figure 35:
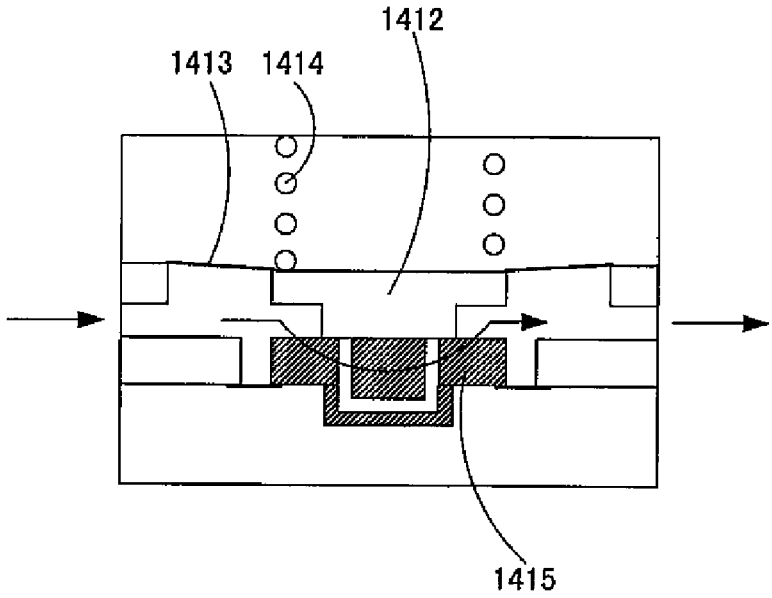
FIG. 35 is an explanatory drawing typically showing the flow of ink inside the sensor module when the ink supply pressure is lower than the biasing force.
Figure 36:
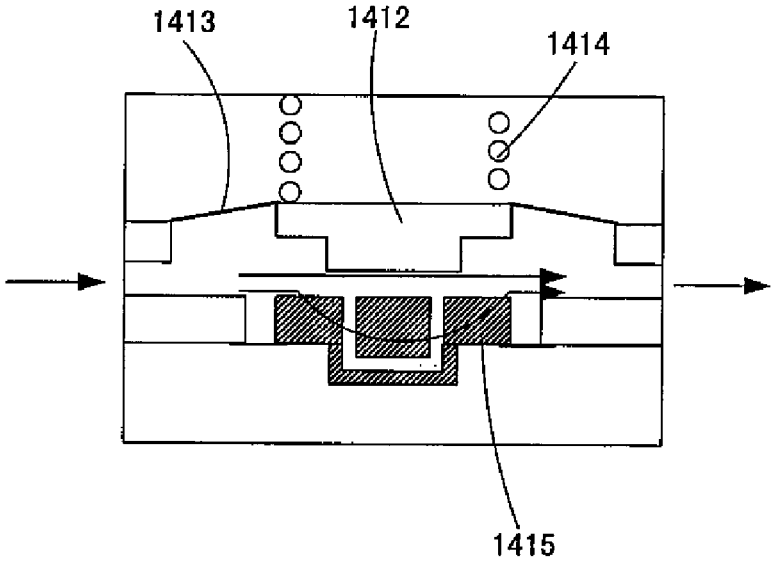
FIG. 36 is an explanatory drawing typically showing the flow of ink inside the sensor module when the ink supply pressure is higher than the biasing force.

Note that the following two modes are conceivable during filling of ink to the ink cartridge 110. FIG. 35 is an explanatory drawing typically showing the flow of ink inside the sensor module when the ink supply pressure is lower than the biasing force. FIG. 36 is an explanatory drawing typically showing the flow of ink inside the sensor module when the ink supply pressure is higher than the biasing force.

When the ink supply pressure is lower than the biasing force, as shown in FIG. 35, the pressure receiving body 1412 and the detection flow path forming member 1415 are left in contact, and without the inflow port to the detection flow path 162 being exposed, the ink flows to the ink receptor 130 exclusively through the ink flow path 161. Therefore, by the air removal process described previously, while there is a requirement for introduction of ink to the detection flow path 162, the detection flow path 162 is plugged by the pressure receiving body 1412, so there is little mixing of air bubbles into the detection flow path 162, and it is possible to reduce the residual air bubbles inside the ink flow path 161.

Meanwhile, when the ink supply pressure is higher than the biasing force, as shown in FIG. 36, the pressure receiving body 1412 and the detection flow path forming member 1415 are divided. Therefore, the inflow port to the detection flow path 162 is exposed, and the ink flows to the ink receptor 130 through the detection flow path 162 and the ink flow path 161. In this case, by the air removal process described previously, discharging of the air bubbles mixed in the ink introduced inside the detection flow path 162 is induced. It is also possible to shorten the time required for the ink filling process.

Note that with this embodiment, the sensor module 141 is filled with ink during the ink filling process, so the air removal process for introducing ink to the sensor module of the prior art is unnecessary, and the air removal process noted above should be distinguished from the prior art air removal process for filling ink to the sensor module.

As described above, with the ink filling method of the fourth embodiment, the ink filling is executed in a state with the ink receptor 130 and the ink volume sensor 140 mounted on the case 120, so it is possible to prevent or suppress ink leakage. Specifically, the ink filling process is executed with the ink receptor 130 and the ink volume sensor 140 connected, so it is possible to prevent or suppress the ink leakage when connecting the ink sensor to an ink receptor filled with ink that occurred with the prior art. As a result, the work of removing the leaked ink and the like during filling of ink to the ink cartridge is unnecessary, and it is possible to make the ink filling process more efficient.

Also, the ink filling process is executed in a state with the ink receptor 130 and the ink volume sensor 140 connected, so the ink volume sensor 140 interior is filled with ink during the filling process. Therefore, it is possible to not execute the ink filling process to the ink volume sensor that was performed with the prior art in addition to the ink filling process to the ink receptor. As a result, it is possible to make the ink filling process simpler.

Furthermore, when filling ink in the ink cartridge 110 that has been used, in addition to what is noted above, it is also possible to enjoy the advantage that it is possible to execute refilling of ink to the ink receptor 130 without disassembling the used ink cartridge 110.

Fifth Embodiment

Figure 37:
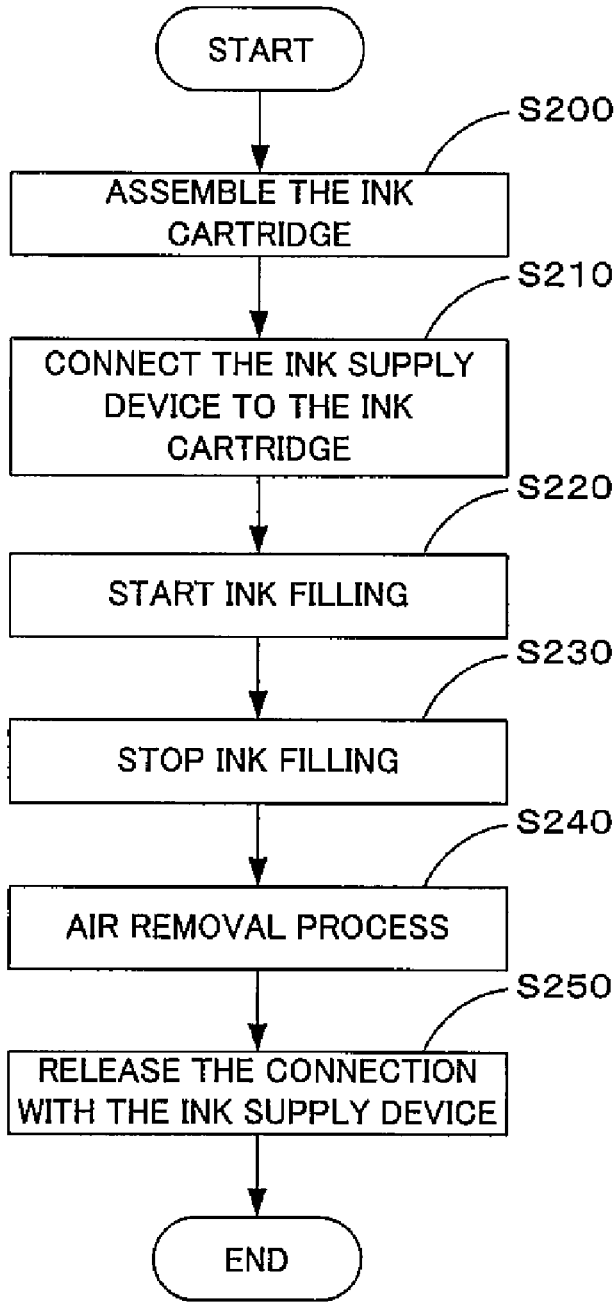
FIG. 37 is a flow chart showing the ink cartridge manufacturing process of the fifth embodiment.

The method of manufacturing the ink cartridge of the fifth embodiment will be described following. FIG. 37 is a flow chart showing the ink cartridge manufacturing process of this embodiment. With this embodiment filling of the ink to the assembled ink cartridge is executed, so first, assembly of the ink cartridge is executed (step S200). In specific terms, the ink receptor 130 and the ink volume sensor 140 are incorporated in the case 120, and the opening of the ink receiving chamber 120*a* and the sensor receiving chamber 120*b* was plugged using the sealing material 150. With this embodiment, first, the ink receptor 130 is arranged in the ink receiving chamber 130*a*, and subsequently, the first connecting unit 140*a* of the ink volume sensor 140 is arranged in the sensor receiving chamber 120*b* of the ink volume sensor 140 while being inserted in the ink lead-out unit 131 of the ink receptor 130. Insertion of the first connecting unit 140*a* into the ink lead-out unit 131 can be executed by simply pushing in the first connecting unit 140*a*, or it can be executed by inserting the first connecting unit 140*a* while rotating, and making it such that the first connecting unit 140*a* and the ink lead-out unit 131 or the wall surface 120*c* mechanically lock.

A tube shaped member that becomes the ink supply port 122 is mounted on the second connecting part 140*b* of the ink sensor 140 received in the sensor receiving chamber 120*b*. Also, the pressurization tube 123 (normally formed as an integrated unit with the case 120) is mounted on the third opening 121*c* and the fourth opening 121*d* of the case 120. Subsequently, the sealing material 150 is arranged in the opening of the case 120, and the sealing material 150 and the case 120 (end surface of the wall surface 120*c*) are adhered using heat bonding, ultrasonic welding or the like. Finally, the lid 125 is mounted on the case 120 and the assembly of the ink cartridge 110 is ended. Note that the mounting of the lid 125 can also be executed after completion of the ink filling process.

When the ink cartridge 110 is completed, the ink filling process (steps S210 to S250) corresponding to the previously described ink filling process (steps S100 to S130) is executed. Specifically, to describe this briefly, the ink supply device is connected to the ink supply port 122 of the ink cartridge 110 (step S210), and the filling of ink to the ink receptor 130 is started (step S220). When filling of a specified volume of ink is completed, the ink filling process is stopped (step S230), the air removal process is executed (step S240), the connection between the ink cartridge 110 ink supply port 122 and the ink supply device is released (step S250), and the ink cartridge 110 manufacturing process is completed.

Figure 38:
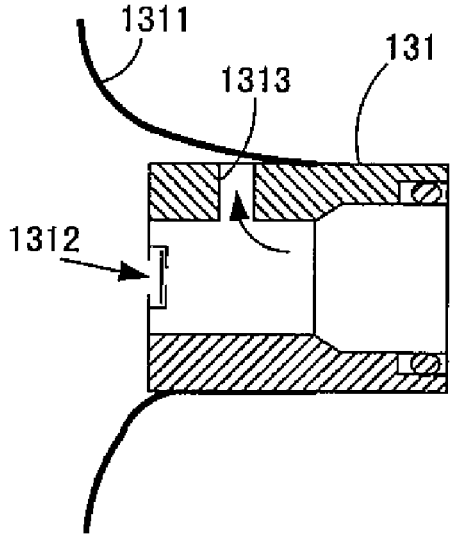
FIG. 38 is an explanatory drawing showing an example of the ink lead-out unit equipped with a return check valve.
Figure 39:
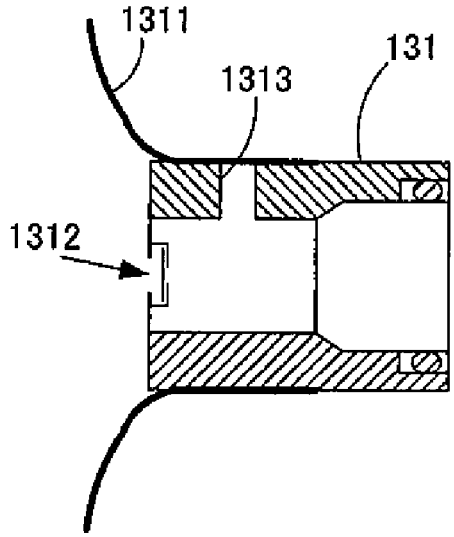
FIG. 39 is an explanatory drawing showing the state of the return check valve functioning with the ink lead-out unit equipped with a return check valve.

Note that with the ink cartridge 110 manufacturing process, it is possible to execute ink filling using a high supply pressure with the method described below even for the ink receptor 130 equipped with the return check valve. FIG. 38 is an explanatory drawing showing an example of the ink lead-out unit equipped with a return check valve. FIG. 39 is an explanatory drawing showing the state of the return check valve functioning with the ink lead-out unit equipped with a return check valve.

With the example shown in FIG. 38, the ink lead-out unit 131 is equipped with the film material 1311 that forms the bag of the ink receptor 130, the return check valve 1312, and the bypass path 1313. During ink filling, the bypass path 1313 and the interior of the ink receptor 130 are linked, so the ink supplied to the ink lead-out unit 131 flows to the inside of the ink receptor 130 via the bypass path 1313 though it cannot pass through the return check valve 1312. At the point that filling of the ink to the ink receptor 130 is completed, as shown in FIG. 39, if the bypass path 1313 is sealed by the film material 1311, the only path for the ink receptor 130 is the path via the return check valve 1312. As a result, the return check valve 1312 switches to the functioning state. Note that the sealing of the bypass path 1313 by the film material 1311 can be executed by heat bonding, for example.

When using this mode, the welding of the sealing material 150 to the case 120 is executed after filling of the ink to the ink receptor 130 has ended and the sealing of the bypass path 1313 is completed.

As described above, with the ink cartridge manufacturing method of this embodiment, filling of the ink is executed in a state with the ink receptor 130 and the ink volume sensor 140 mounted on the case 120, so it is possible to prevent or suppress ink leakage during ink cartridge manufacturing. As a result, it is possible to prevent or suppress dirtying of the ink cartridge due to ink leakage, and the work step of removing leaked ink or the like is unnecessary, so it is possible to make the manufacturing process more efficient.

Also, the ink filling process is executed in a state with the ink receptor 130 and the ink volume sensor 140 connected, so the inside of the ink volume sensor 140 is filled with ink during the filling process. Therefore, it is possible to not execute the ink filling process to the ink volume sensor that was performed with the prior art in addition to the ink filling process to the ink receptor. As a result, it is possible to simplify the ink cartridge manufacturing process.

Ink Cartridge Application Example

Figure 40:
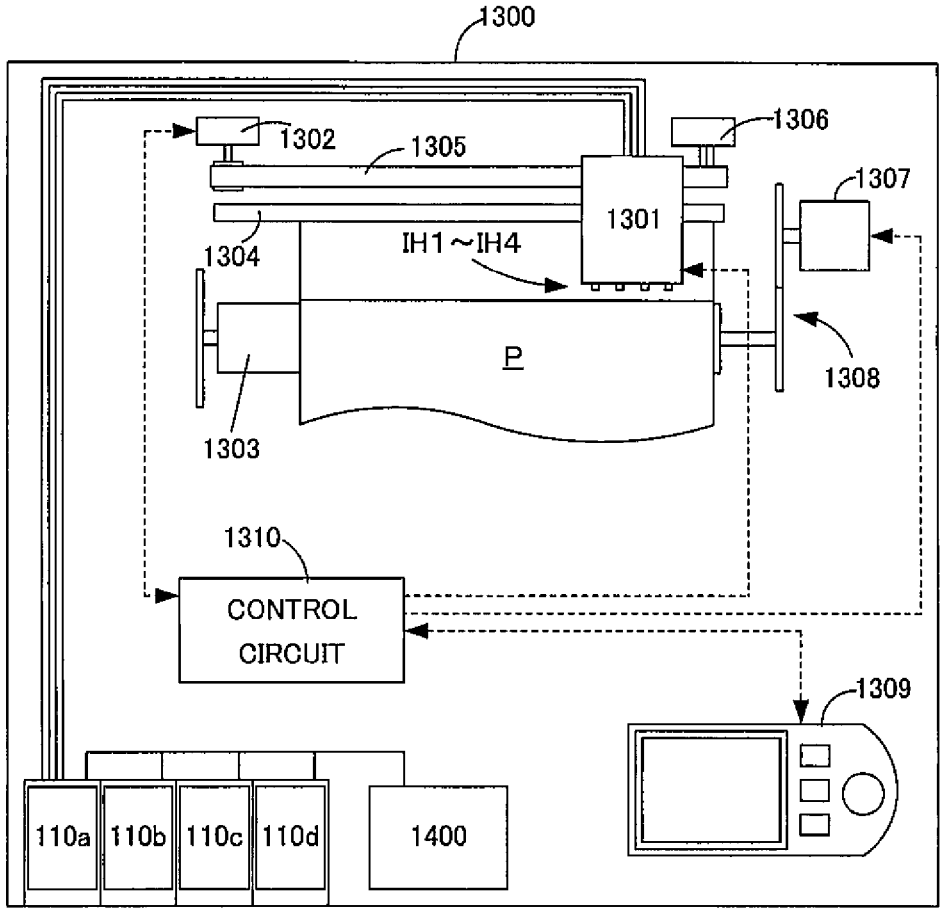
FIG. 40 is a schematic structure diagram of the printing device used with an ink cartridge of the fourth and fifth embodiments mounted.

As an application example of the ink cartridge 110 manufactured using the ink cartridge manufacturing method of this embodiment, we will briefly describe this using an example of the ink cartridge 110 incorporated in a printing device. FIG. 40 is a schematic structure diagram of the printing device used with an ink cartridge of this embodiment mounted.

The printing device 1300 is equipped with a main scan feed mechanism, a sub scan feed mechanism, a printing head drive mechanism, and a control circuit 1310 for controlling the drive of each of these mechanisms as well as for executing the various program functions for controlling the consumption volume of ink as the liquid.

The main scan feed mechanism is equipped with a carriage motor 1302 for driving the carriage 1301, a sliding axis 1304 for slidably holding the carriage 1301 installed in parallel with the axis of the platen 1303, a pulley 1306 for which an endless drive belt 1305 is extended between it and the carriage motor 1302, and a position sensor (not illustrated) for detecting the origin point position of the carriage 1301. The main scan feed mechanism moves the carriage 1301 back and forth in the axis direction (main scan direction) of the platen 1303 using the carriage motor 1302.

The carriage 1301 is equipped with printing heads IH1 to IH4. Ink is supplied to the printing heads IH1 to IH4 from a plurality of ink cartridges 110*a* to 110*d* arranged at different positions from the printing heads IH1 to IH4. Specifically, the printing device 1300 is an off-carriage type printing device. Note that for the ink cartridge 110, it goes without saying that instead of an off-carriage type, it is also possible to mount on the printing device an on-carriage type for which the ink cartridge is mounted on a holder equipped on the printing head.

Pressurized air of a specified pressure is supplied from a compressor 1400 to the ink cartridges 110*a* to 110*d*. Specifically, by having the pressure inside the ink receptor 130*a* be a specified pressure via the pressurization tube 123, a specified pressure is applied to the ink receptor 130 and the supplying of the ink is stabilized.

The sub scan feed mechanism is equipped with a paper feed motor 1307, and a gear train 1308. The sub scan feed mechanism conveys the printing paper P in the sub scan direction by transmitting the rotation of the paper feed motor 1307 to the platen 1303 via the gear train 1308.

The head driving mechanism drives the printing heads IH1 to IH4 incorporated in the carriage 1301, controls the ink discharge volume and timing, and forms the desired dot patterns on the printing medium. As the ink driving mechanism, for example, it is possible to use a drive mechanism using piezoelectric deformation for which distortion occurs due to voltage application, or a drive mechanism that uses air bubbles that occur inside the ink using a heater heated by the application of voltage.

The control circuit 1310 is connected to the carriage motor 1302, the paper feed motor 1307, and the operating panel 1309 via a signal line. The control circuit 1310 also can be connected to a computer or a digital still camera via input/output terminals. The control circuit 1310 drives the carriage motor 1302, the paper feed motor 1307, and the printing heads IH1 to IH4 according to instructions from the computer and the operating panel 1309, or according to various programs stored in the control circuit 1310.

Figure 41:
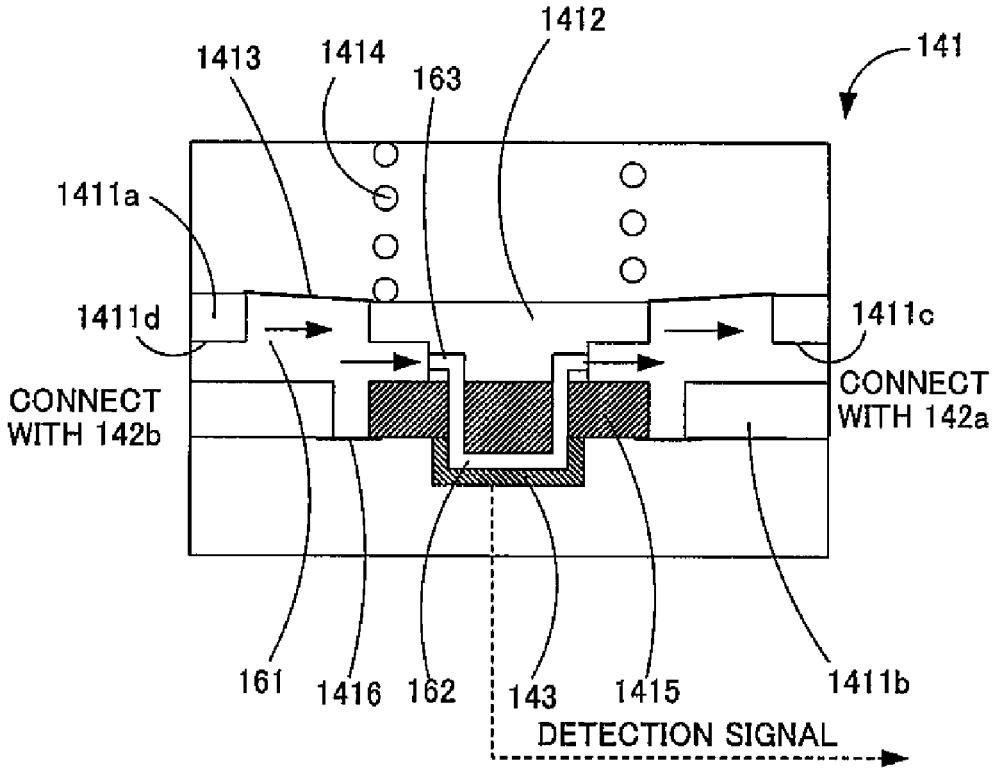
FIG. 41 is an explanatory drawing typically showing the internal structure of the sensor module of another embodiment.

Alternative Embodiments (1) It is also possible to equip a pressure receiving body flow path 163 that is linked with the detection flow path 162 and the ink flow path 161 on the pressure receiving body 1412 that constitutes the sensor module 141. FIG. 41 is an explanatory drawing typically showing the internal structure of the sensor module of another embodiment. By forming the pressure receiving body flow path 163 on the pressure receiving body 1412, it is possible to make introduction of ink to the detection flow path 162 easier. Specifically, by equipping the pressure receiving body flow path 163 parallel to the ink flow direction during the ink filling process, even in a state when the pressure receiving body 1412 and the detection flow path forming member 1415 are not sufficiently divided, it is possible to effectively introduce ink to the detection flow path 162. It is also possible to make introduction of the ink to the detection flow path 162 more efficient by adjusting the distance between the pressure receiving body flow path 163 and the linking unit 1411*c*.

(2) With each of the embodiments noted above, the lid 125 was used, but it is also possible to not use the lid 125. Specifically, this is because though the lid 125 exhibits the function of stopping damage to the sealing material 150, the ink receiving chamber 130*a* and the sensor receiving chamber 130*b* are sealed by the sealing material 150, and it is possible to execute pressurization processing on the ink receiving chamber 130*a*. Also, by using a flexible, thin plate member as the sealing material 150, the lid 125 is no longer an essential constitutional member when the strength of the sealing material 150 itself is increased.

(3) With each of the embodiments noted above, the ink supply port 122 is arranged with an offset in relation to the ink lead-out unit 131, but the ink lead-out unit 131 and the ink supply port 122 can also be arranged on roughly the same line. It is acceptable as long as there is an optimal arrangement structure that is suitable according to the internal flow path structure of the ink flow sensor 140.

(4) With each of the embodiments noted above, when filling ink, the ink supply pump PP was used, but instead of this, it is also possible to execute the ink filling process using the water head difference which is the height difference of the ink cartridge 110 and the ink reservoir tank 1200. In this case, it is possible to execute ink filling without using a power source.

(5) With each of the embodiments noted above, during ink filling, pressurized filling is executed using the ink supply pump PP, but it is also possible to fill ink using vacuum suction using a suction pump such as a vacuum pump or the like. In this case, it is possible to smoothly execute ink filling.

(6) With each of the embodiments noted above, we described examples with ink as the liquid, but instead of this, it is also possible to apply this to a liquid container for housing drinking water.

(7) With each of the embodiments noted above, the sealing material 150 is not limited to being a film shaped material, but can also be a somewhat thin plate material having flexibility. Also, as the sealing material 150, when a material different from that of the case 120 is used, it is acceptable as long as the same material as the case 120 is arranged at the contact surface with the wall surface 120*c* at least at the sealing material 150.

While the present invention is described hereinabove based on certain preferred embodiments, these are intended to aid understanding of the invention and should not be construed as limiting of the invention. It is to be understood that the present invention may be embodied with various changes, modifications and improvements which may occur to those skilled in the art, without departing from the spirit and scope of the invention.

The following Japanese patent applications as the basis of the priority claim of this application are incorporated in the disclosure hereof by reference:

Japanese Patent Application No. 2007-234009 (filing date: Sep. 10, 2007);

Japanese Patent Application No. 2007-234955 (filing date: Sep. 11, 2007); and

Japanese Patent Application No. 2007-254488 (filing date: Sep. 28, 2007).

What is claimed is:

1. A method of manufacturing a liquid container, comprising:

preparing the liquid container having a storage container capable of storing a liquid receptacle, the liquid housed in the liquid receptacle is supplied to the outside via a flow path inside a liquid volume detector device;

filling the liquid receptacle stored in the storage container with a liquid;

connecting the liquid volume detector device to the liquid receptacle filled with liquid; and introducing the liquid that has been filled to the liquid receptacle into the flow path of the liquid volume detector device.

2. A method in accordance with claim 1, further comprising:

removing the liquid volume detector device connected to the liquid receptacle; and wherein the filling the liquid receptacle with liquid is executed by charging the liquid into the liquid receptacle from which the liquid volume detector device has been removed.

3. A method in accordance with claim 1, wherein the storage container has an opening that is closed by a flexible member, the filling the liquid into the liquid receptacle is executed by filling the liquid receptacle stored in the storage container using the opening.

4. A method of manufacturing a liquid container comprising:

preparing a liquid receptacle capable of accommodating a liquid;

storing the liquid receptacle in a storage container capable of storing the liquid receptacle:

charging liquid into the liquid receptacle stored in the storage container;

connecting a liquid volume detector device to the liquid receptacle filled with liquid; and introducing a liquid charged into the liquid receptacle to a flow path of the liquid volume detector device.

5. A method in accordance with claim 4, further comprising:

using a flexible member to seal off an opening of the storage container in which the liquid receptacle is stored.

6. A method in accordance with claim 1, wherein the liquid is ink, and the introducing the liquid into the liquid receptacle is executed by introducing ink of a specified temperature into a flow path of the liquid volume detector device.

7. A method in accordance with claim 4, wherein the liquid is ink, and the introducing the liquid into the liquid receptacle is executed by introducing ink of a specified temperature into a flow path of the liquid volume detector device.

8. A method of manufacturing a liquid container, comprising:

preparing a liquid container in which a liquid receptacle and a liquid supply port are linked via a liquid volume detector;

connecting a liquid reservoir and the liquid supply port; and filling liquid in the liquid receptacle housed in the liquid container and connected with the liquid volume detector via the liquid supply port and the liquid volume detector, wherein the liquid volume detector has a first flow path connecting the liquid supply port and the liquid receptacle, and a second flow path closed off under specified urging force by an urging member, and the filling the liquid in the liquid receptacle is pressurized filling that is executed using pressure of the urging force or less.

9. A method of manufacturing a liquid container, comprising:

preparing a liquid container in which a liquid receptacle and a liquid supply port are linked via a liquid volume detector;

connecting a liquid reservoir and the liquid supply port; and filling liquid in the liquid receptacle housed in the liquid container and connected with the liquid volume detector via the liquid supply port and the liquid volume detector wherein the liquid volume detector has a first flow path connecting the liquid supply port and the liquid receptacle, and a second flow path closed off under specified urging force by an urging member, and the filling the liquid in the liquid receptacle is pressurized filling that is executed using pressure higher than the urging force.

10. A method in accordance with claim 8, further comprising:

discharging part of the charged liquid from the liquid supply port of the liquid container that is filled with liquid.

11. A method in accordance with claim 8, wherein the liquid receptacle has a return check valve unit that operates by being operated from the outside, and the method further comprises activating the return check valve unit of the liquid receptacle after being filled with liquid.

12. A method in accordance with claim 8, wherein the liquid container is an used liquid container, and the filling the liquid receptacle with liquid is refilling.

13. A method in accordance with claim 9, further comprising:

discharging part of the charged liquid from the liquid supply port of the liquid container that is filled with liquid.

14. A method in accordance with claim 9, wherein the liquid receptacle has a return check valve unit that operates by being operated from the outside, and the method further comprises activating the return check valve unit of the liquid receptacle after being filled with liquid.

15. A method in accordance with claim 9, wherein the liquid container is an used liquid container, and the filling the liquid receptacle with liquid is refilling.

* * * * *